US010959598B2

(12) United States Patent
Meyer et al.

(10) Patent No.: US 10,959,598 B2
(45) Date of Patent: Mar. 30, 2021

(54) DOORMAT WITH REMOVABLE MAT INSERT

(71) Applicant: PORCH + HALL, LLC, Bronxville, NY (US)

(72) Inventors: Stafford Meyer, Bronxville, NY (US); Terence Gelo, Houston, TX (US)

(73) Assignee: PORCH + HALL, LLC, Bronxville, NY (US)

( * ) Notice: Subject to any disclaimer, the term of this patent is extended or adjusted under 35 U.S.C. 154(b) by 164 days.

(21) Appl. No.: 16/010,979

(22) Filed: Jun. 18, 2018

(65) Prior Publication Data

US 2018/0368655 A1 Dec. 27, 2018

Related U.S. Application Data

(60) Provisional application No. 62/523,440, filed on Jun. 22, 2017.

(51) Int. Cl.
*A47L 23/26* (2006.01)

(52) U.S. Cl.
CPC ..... *A47L 23/266* (2013.01); *A47L 23/26* (2013.01)

(58) Field of Classification Search
CPC ..... A47L 23/26; A47L 23/266
See application file for complete search history.

(56) References Cited

U.S. PATENT DOCUMENTS

| | | | | |
|---|---|---|---|---|
| 8,859,073 | B1 * | 10/2014 | Callas | B32B 9/00 343/720 |
| 2002/0028313 | A1 * | 3/2002 | Blum | A47L 23/266 428/54 |
| 2002/0092110 | A1 * | 7/2002 | Blum | A47L 23/22 15/215 |
| 2008/0166521 | A1 * | 7/2008 | Kessler | A47L 23/266 428/137 |
| 2011/0123761 | A1 * | 5/2011 | Wright | B60N 3/048 428/116 |
| 2017/0360274 | A1 * | 12/2017 | Love | B32B 25/10 |

* cited by examiner

*Primary Examiner* — Randall E Chin
(74) *Attorney, Agent, or Firm* — Cowan, Liebowitz & Latman, P.C.; Anastasia Zhadina

(57) ABSTRACT

Doormat assembly comprising a base including a central area and a peripheral area surrounding the central area, and having an upper surface and an opposing lower surface, a frame assembly overlapping with at least a portion of the upper surface of the peripheral area of the base and forming a frame with a central opening for exposing the central area of the base, and a removable insert sized to fit within the central opening of the frame assembly and to cover the central area of the base, wherein the frame assembly is formed separately from the base and the frame assembly comprises different materials from the base, and wherein the removable insert is removable through the central opening in the frame and replaceable.

23 Claims, 26 Drawing Sheets

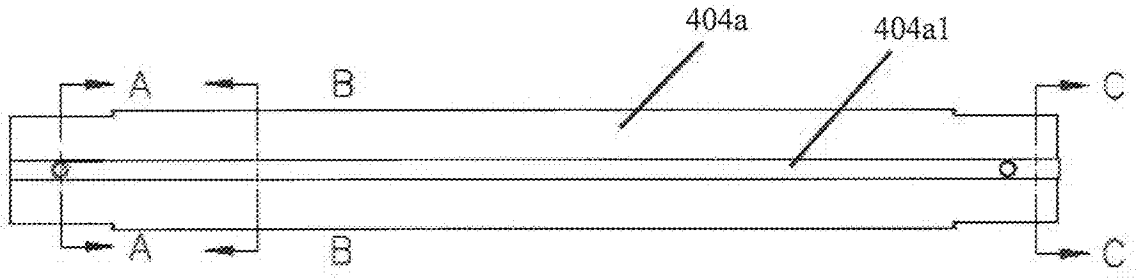
FIG. 20A
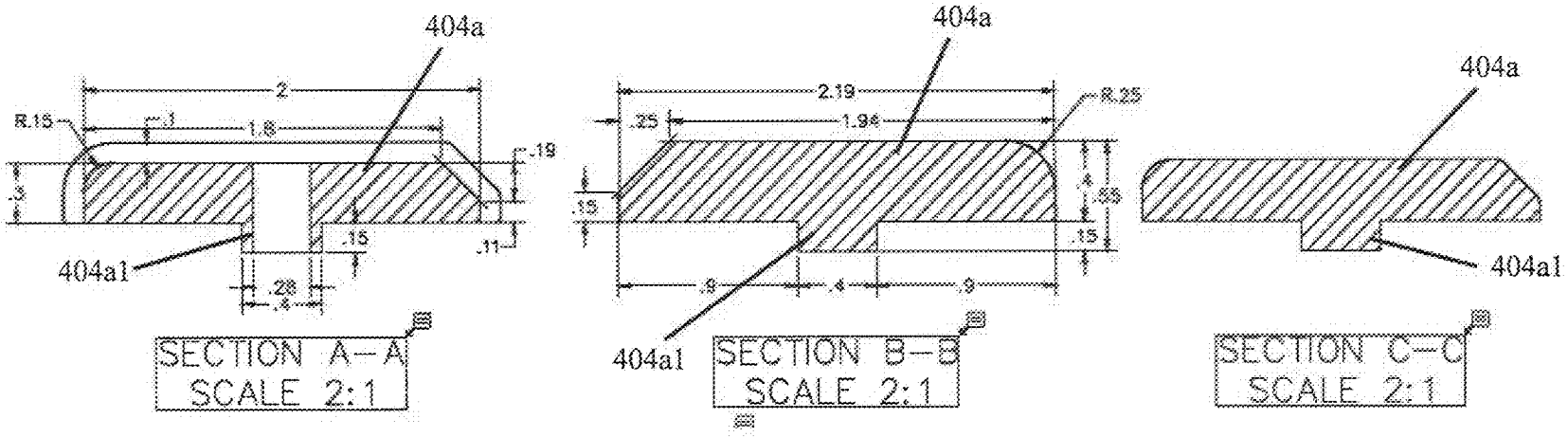
FIG. 20B
FIG. 20C
FIG. 20D

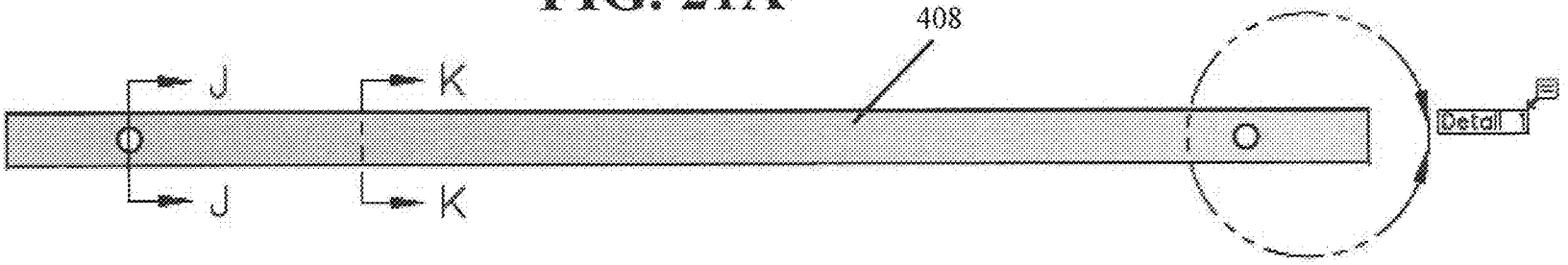
FIG. 21A
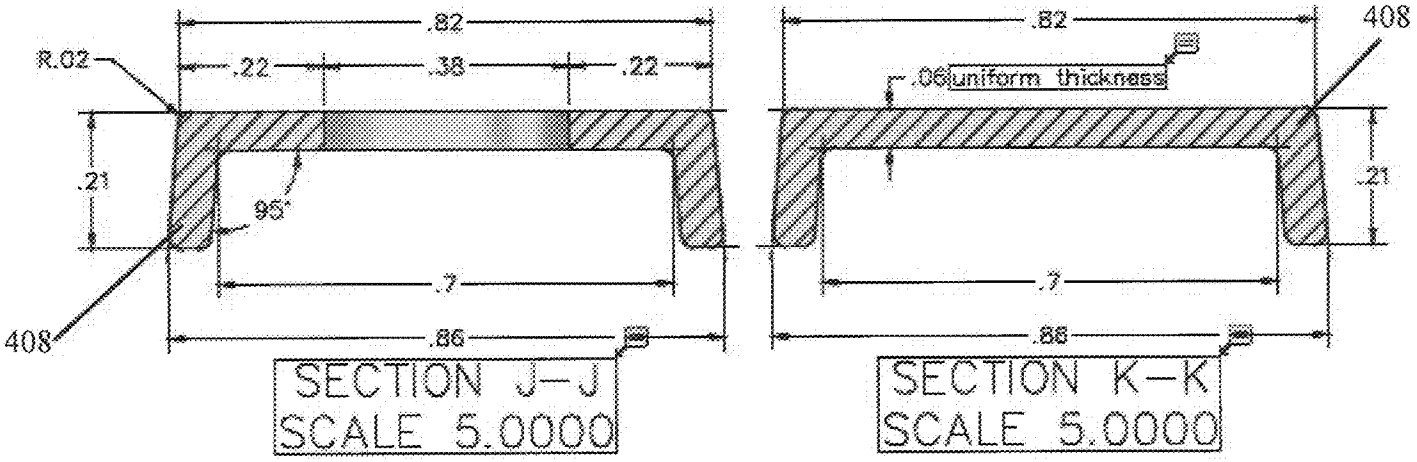
FIG. 21B
FIG. 21C

DOORMAT WITH REMOVABLE MAT INSERT

INTRODUCTION

The present invention relates to a doormat with a removable mat insert and a decorative frame, and which can be used outdoors or indoors.

Doormats are commonly used outside or inside an entrance to a building, such as a house, to allow persons entering the building to scrub or wipe their shoes in order to keep dirt, mud, water, sand and/or snow from being tracked through the building. Typically, doormats are made from tough, long-lasting materials such as coir, rubber and other materials. Durability and ability to keep the underlying and surrounding floor surfaces dry are important features of a doormat.

Some doormats may include decorative elements, such as a design or a word on the upper surface of a doormat. For example, words such as "welcome" or humorous messages may be used as a decorative element on the upper surface of a doormat. Customization of a doormat design and the decorative elements used on the doormat may be desired by the owner or inhabitant of the building.

SUMMARY OF THE INVENTION

It is an objective of the present invention to provide a doormat which is sufficiently durable for either indoor or outdoor use. It is another objective of the invention to provide a doormat which has a removable central insert for easy cleaning or replacement. Moreover, the doormat of the present invention allows easy customization by removing the central insert and replacing it with another insert having a different appearance. It is yet another objective of the invention to provide a doormat for outdoor use which has a drainage ability so that water is not retained by the doormat, particularly during wet weather. Moreover, the doormat of the present invention has a durable and lightweight construction.

In accordance with the present invention, a doormat assembly is provided, comprising a base including a central area and a peripheral area surrounding the central area, and having an upper surface and an opposing lower surface, a frame assembly overlapping with at least a portion of the upper surface of the peripheral area of the base and forming a frame with a central opening for exposing the central area of the base, and a removable insert sized to fit within the central opening of the frame assembly and to cover the central area of the base. The frame assembly is formed separately from the base and the frame assembly comprises different materials from the base, and the removable insert is removable through the central opening in the frame and replaceable. In certain embodiments, the base comprises rubber material and the central area of the base includes a plurality of through openings for draining fluids. The through openings are provided at substantially regular intervals throughout the central area of the base. In certain illustrative embodiments, the through openings are hexagonally-shaped openings arranged in a honeycomb pattern throughout the central area of the base. The base may be formed from at least one of nitrile-butadiene rubber (NBR) and styrene-butadiene rubber (SBR). In some embodiments, the thickness of the central area of the base is substantially the same and each of the through openings includes a beveled edge.

In certain embodiments of the invention, the peripheral area of the base is configured to engage with the frame assembly. The frame assembly may comprise a plurality of side members and a plurality of corner portions engaged with the side members to form the frame. In some embodiments, each end of one of the side members and the corner portions includes an opening and each end of the other one of the side members and the corner portions includes a recessed portion adapted to fit within the opening in the end of said one of the side members and the corner portions. In certain embodiments, the side members are formed from one or more of wood and bamboo, and wherein the corner portions are formed from a metallic material.

In certain embodiments, the peripheral area of the base includes a channel extending along its length, and each of the plurality of side members and each of the plurality of corner portions includes a protrusion extending along its length, the protrusion being configured to fit into the channel in the peripheral area. The peripheral area of the base includes an inner frame-shaped protrusion extending around the central area of the base and an outer frame-shaped protrusion extending around the inner frame-shaped protrusion, and the channel in the peripheral area is formed between the inner frame-shaped protrusion and the outer frame-shaped protrusion.

The doormat assembly of certain embodiments further comprises support brackets abutting the lower surface of the peripheral area of the base, wherein the support brackets engage with the peripheral area of the base and the frame assembly. The lower surface of the peripheral area of the base includes a channel configured to accommodate the support brackets, and the support brackets engage with the peripheral area of the base and the frame assembly using connectors.

In the embodiments described below, the size of the removable insert corresponds to the opening in the frame. The removable insert comprises one or more of coir, horsehair bristles and polypropylene.

BRIEF DESCRIPTION OF THE DRAWINGS

The above and other features and aspects of the present invention will become more apparent upon reading the following detailed description in conjunction with the accompanying drawings, in which:

FIGS. 20A-20D show in more detail a side member of the frame of the doormat of FIGS. 18A-18C; and FIGS. 21A-21C show in more detail a support bracket of the doormat of FIGS. 18A-18C.

DETAILED DESCRIPTION

Figure 1:
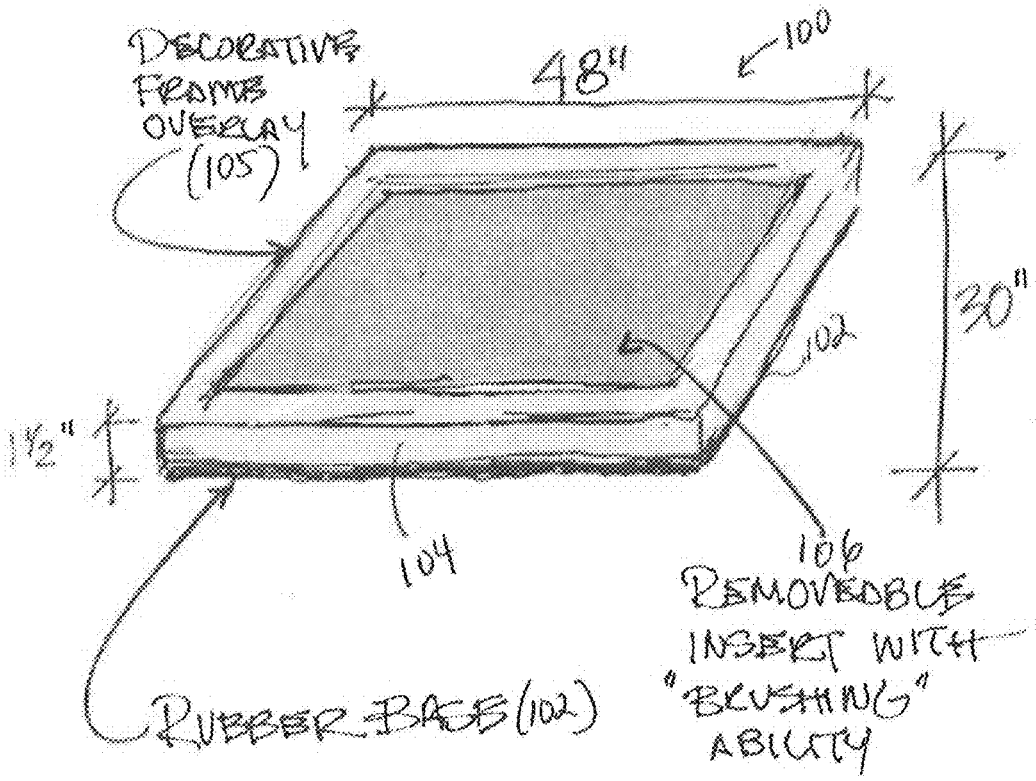
FIG. 1 is a first embodiment of a doormat of the present invention.
Figure 2:
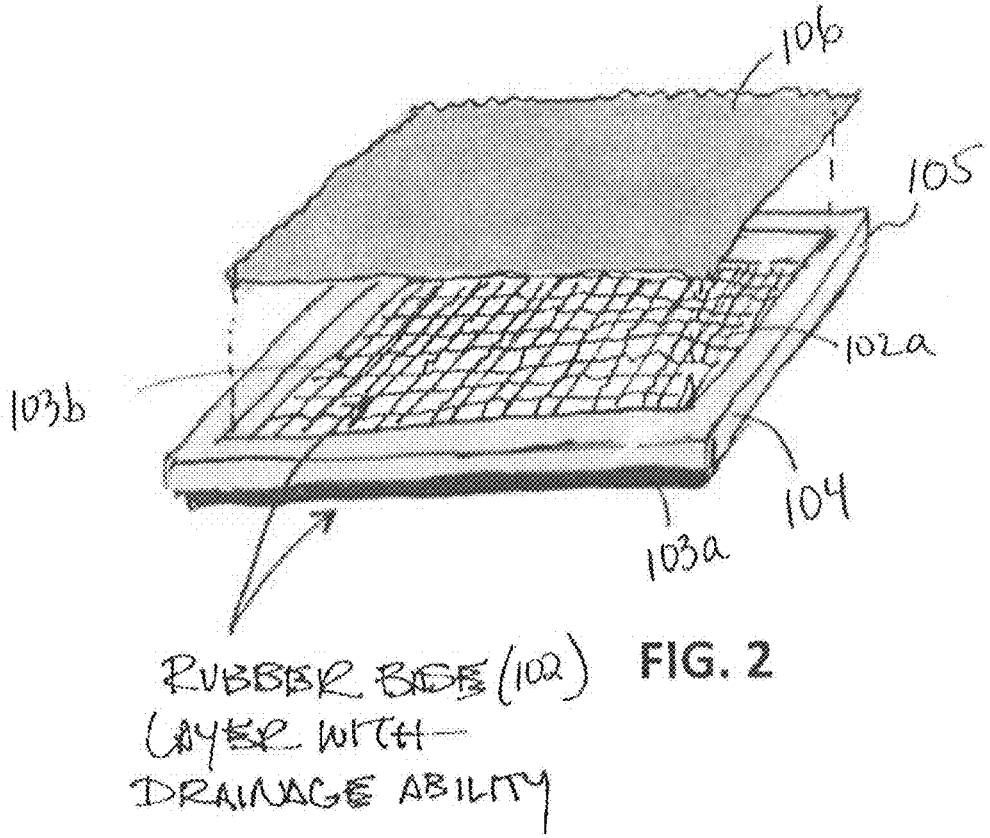
FIG. 2 is a more detailed view of the doormat of FIG. 1.
Figure 9:
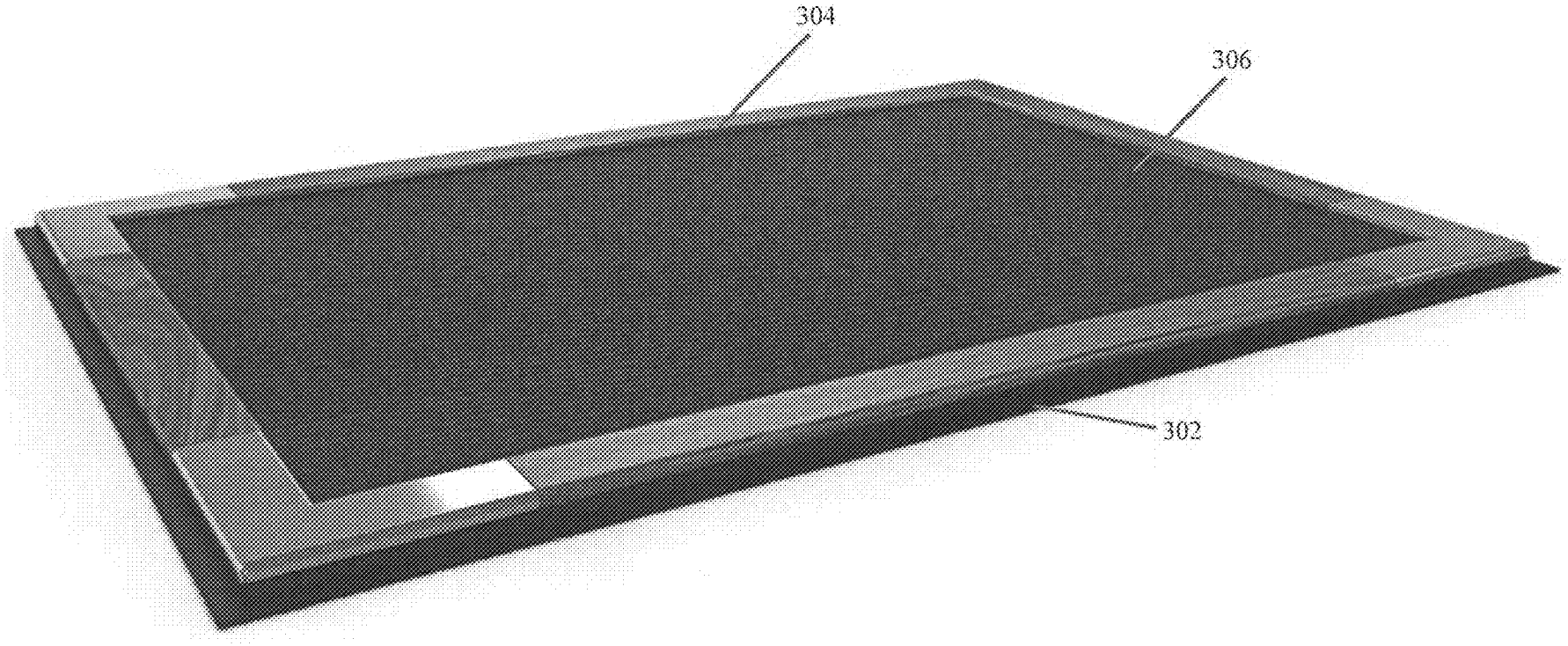
FIG. 9 shows a third embodiment of the doormat of the present invention.
Figure 10A:
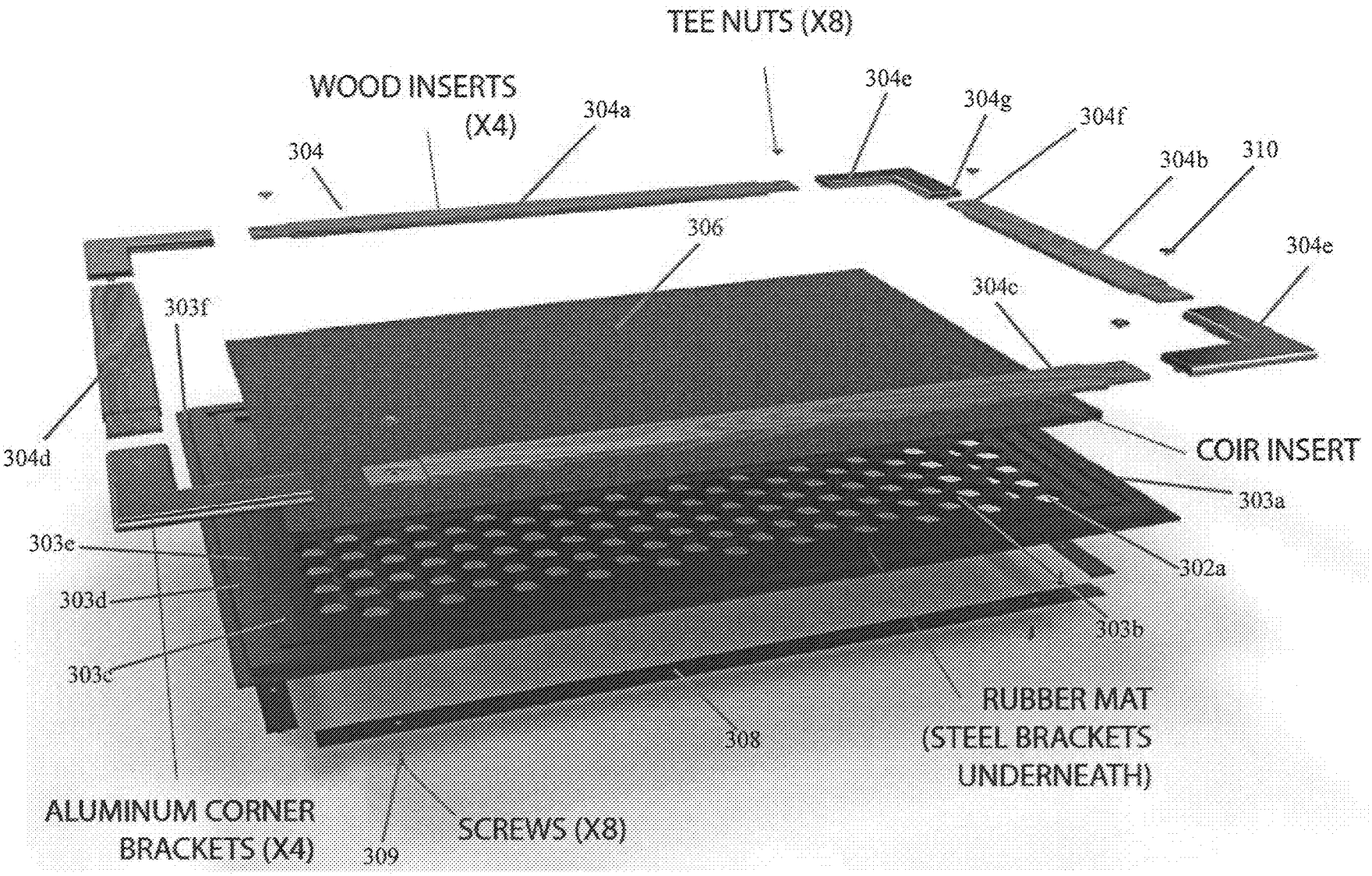
FIGS. 10A-10B show top and bottom exploded views of the doormat of FIG. 9.
Figure 10B:
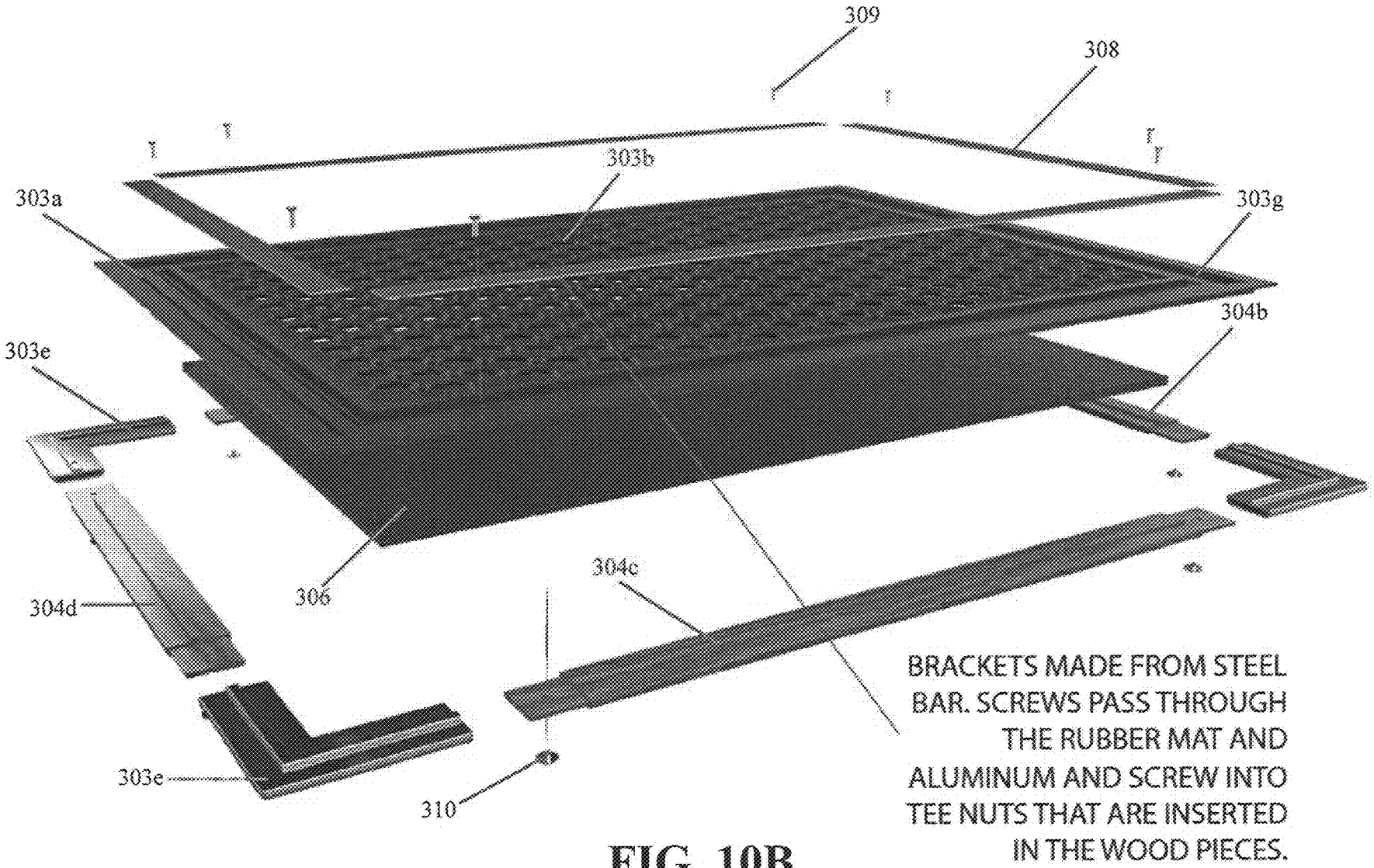

FIGS. 1 and 2 show a first embodiment of a doormat 100 of the present invention, FIGS. 3-5B show a second embodiment of a doormat 200 of the present invention and FIGS. 9-10B show a third embodiment of a doormat 300 of the present invention. The doormat 100/200/300 of the present invention may be used inside or outside of the house and is provided with a removable insert that can be taken out to be cleaned or replaced. The doormat 100/200/300 of the present invention also may include drainage ability, particularly if the doormat is intended to be used outside of the house.

As shown in FIGS. 1 and 2, the doormat 100 of the first embodiment includes a base 102, a frame 104 attached to a top surface of the base 102, and a removable center insert 106. The base 102 may be made of rubber, plastic, resin or any other suitable heavy-duty material, or combination thereof, which is waterproof and can withstand wet conditions and maintain durability and stability at a large range of temperatures from below freezing (below 32° F.) to above 100° F. The base 102 includes a peripheral area 103*a* and a central area 103*b*. A top surface of the peripheral area 103*a*, which extends around a periphery of the base 102, is attached to the frame 104, while a top surface of the central area 103*b* is adapted to abut the removable center insert 106*a*.

As can be seen in FIG. 2, the base 102 may have drainage ability by providing a plurality of openings 102*a* in the central area 103*b* of the base 102. Although the central area 103*b* of the base 102 is shown as having a mesh-type construction with a plurality of substantially rectangular openings, the construction of the central area of the base and of the openings 102*a* are not limited to this particular construction. For example, the central area of the base may include a plurality of openings of any shape, e.g., circular, rectangular, star-shaped, etc., distributed at regular or irregular intervals around the central area. In certain embodiments, a larger number of openings 102*a* dispersed at smaller intervals may be provided in the area closer to the center of the base and a smaller number of openings 102*a* dispersed at larger intervals may be provided in the area closer to the periphery of the base 102. In certain embodiments, the peripheral area 103*a* of the base 102 may have a solid construction, without any openings.

As shown in FIGS. 1 and 2, the frame 104 is attached to the top surface of the peripheral area 103*a* of the base 102. An adhesive, a fastener or any other suitable method of attachment or coupling, or a combination of such methods, may be used to attach the frame 104 to the peripheral area 103*a* of the base 102. In some embodiments, the frame 104 is formed from a single integral piece of material, which may formed using cutting, molding, pressing, 3D printing or other suitable techniques. In other embodiments, the frame 104 is formed from a plurality of members, including at least a first member, a second member, a third member and a fourth member which form respective sides of the frame 104. Each of the plurality of members is connected to or joined with adjacent members using an adhesive or one or more fasteners, such as staples, nails, etc. Moreover, in some embodiments additional components may be used in the frame, such as corner couplings or fastening members for joining adjacent members to one another. The frame 104 may be made from metallic materials, such as steel, stainless steel or aluminum, treated or untreated wood materials, such as teak, or resin, such as concrete-like resin. The material(s) of the frame should be strong enough to withstand a heavy load resulting from stepping, dragging, and other forces acting thereon.

In certain embodiments, the frame 104 may include a decorative overlay 105 provided on exposed surfaces of the frame 104 to create a desired look. For example, the decorative overlay 104*a* may be provided on top, exterior side and interior side surfaces of the frame 104. The decorative overlay 104 is attached to the frame 104 using a suitable adhesive and/or fastener, such as nails or staples. In other embodiments, the frame 104 and overlay 105 may be constructed to interlock with one another. For example, the frame 104 may include one or more recesses extending along its surface while the overlay 105 may include one or more corresponding projections shaped so as to engage and lock together with the one or more recesses in the frame 104. Other suitable methods of attaching the overlay 105 to the frame may be used. The decorative overlay 105 may be formed from a metallic material, such as stainless steel, chrome, nickel, copper, titanium, or other, preferably corrosion and/or rust resistant, metal, a wood material, such as teak, cedar, cypress or other, preferably decay and water resistant wood, a plastic material, a polymer, or a resin. The material of the decorative overlay 105 will depend on the desired decorative appearance.

Although in some embodiments, the frame 104 may include a decorative overlay 105, in other embodiments, it may be possible to achieve the desired appearance by the frame 104 alone, without using any decorative overlay on the surface of the frame 104 and/or by treating or processing the frame 104 material so as to create a desired appearance, e.g., painting, sealing, polishing, etc.

As further shown in FIGS. 1 and 2, the doormat 102 includes a removable center insert 106 which can be inserted inside the frame 104 and on top of the central area 103*b* of the base 102. The size and shape of the removable center insert 106 substantially corresponds to the opening in the frame 104. The removable insert 106 is not permanently attached to the base 102 or the frame and can be removed for cleaning or replacement. The removable insert 106 may be made from any suitable material with brushing ability, including but not limited to coir, horsehair bristles, polypropylene or a combination thereof. Since the insert 106 is removable, the doormat 102 may be customized to the user's desired appearance by using a desired insert 106 and may be customized for different occasions by using different inserts. In addition, the insert 106 may be removed for easy cleaning without requiring cleaning of the entire doormat. Moreover, when the removable insert 106 wears out due to use, replacement of the insert 106 without replacing the entire doormat can be easily accomplished.

Figure 3:
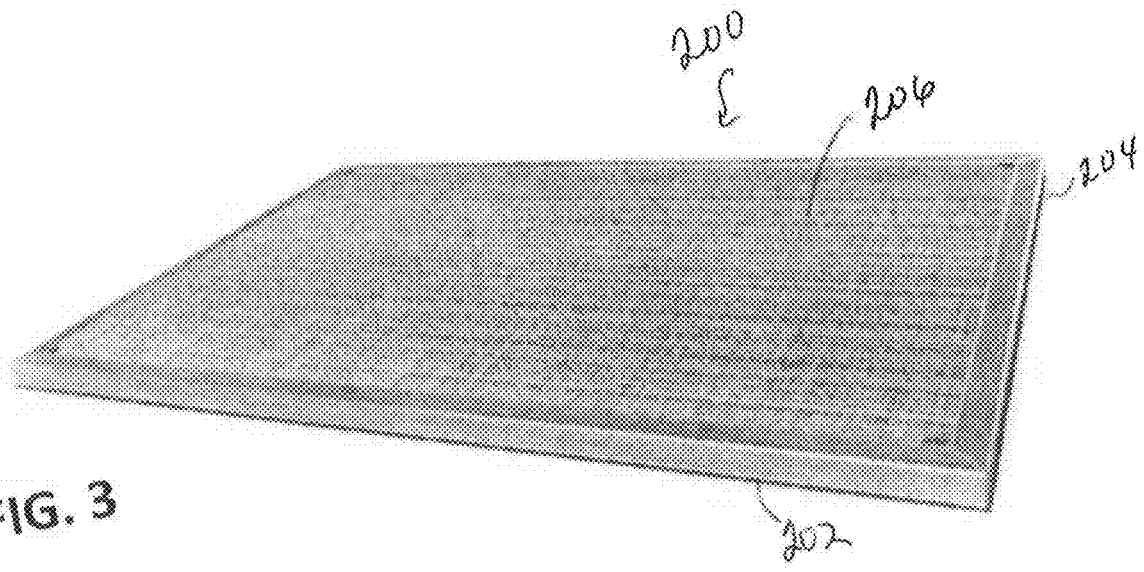
FIG. 3 is a second embodiment of the doormat of the present invention.
Figure 4:
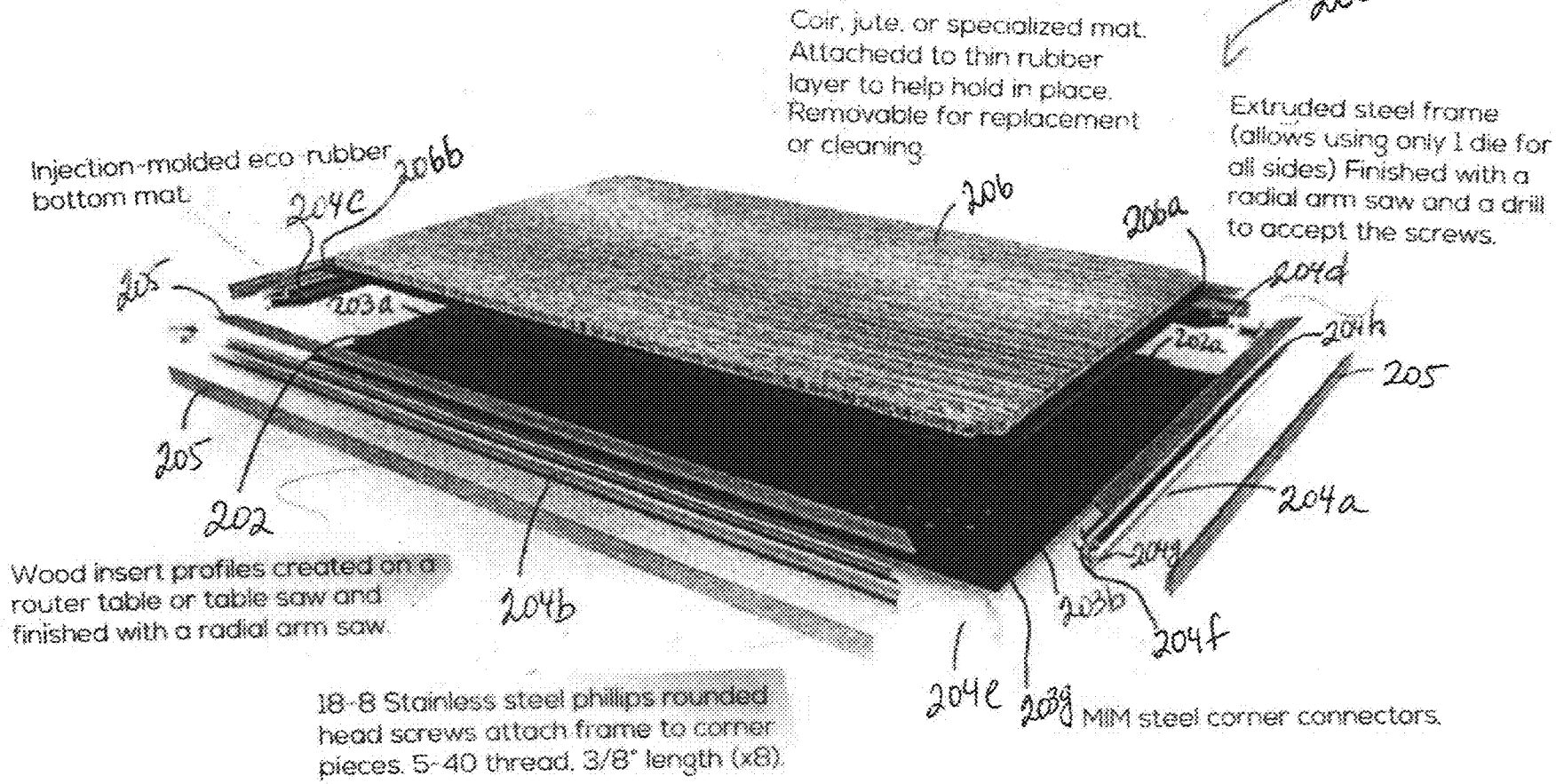
FIG. 4 is a more detailed view of the components of the doormat of FIG. 3 in a disassembled form.

FIGS. 3-5 show the second embodiment of the doormat 200 of the present invention. In the second embodiment, the doormat 200 includes a base 202, a frame 204 holding the base 202 and a removable center insert 206. In certain embodiments, the doormat also includes a decorative frame overlay 205 which is coupled with the frame so as to provide a certain appearance to the frame 204. FIGS. 6-8 show the components of the doormat 200 in more detail.

In the illustrative embodiment shown in FIGS. 4 and 5, the base 202 is made of rubber using injection molding, and preferably from eco-rubber or silicon. However, in other embodiments, the base 202 may be formed from other materials including plastic, resins or any other suitable heavy-duty materials, or a combination thereof, which are waterproof and can withstand wet conditions and maintain durability and stability at a large range of temperatures ranging from below freezing to above 100° F.

As shown in FIGS. 4 and 5, the base 202 includes a peripheral area 203*a* extending around a periphery of the base 202 and a central area 203*b* surrounded by the peripheral area 203*a*. In the embodiment shown, the central area 203*b* includes a plurality of openings 202*a* which provide drainage for any liquids trapped by the doormat. In the illustrative embodiment of FIGS. 4 and 5, the openings have a hexagonal shape and are arranged at uniform intervals throughout the central area 203*b*. However, as discussed above, the shape of the openings may be varied (e.g., circular, rectangular, etc.) and the density of the openings in the central area 203*a* may also be varied. In yet other embodiments, the base 202 may have a solid construction without any openings, particularly for doormats that are intended for use indoors. The arrangement of the openings 202*a* is shown in more detail in FIG. 6. As shown in FIG. 6, a cross-section of each opening 202*a* may have a first width at the upper surface of the base 202 and decrease to a second width, smaller than the first width, toward the center of the base's thickness. In addition, the cross-section of each opening 202 may increase slightly to a third width, which is slightly larger than the second width but smaller than the first width, at the lower surface of the base 202.

As shown, the peripheral area 203*a* includes first and second portions 203*c* and 203*d* partially overlapping with one another and separated by a channel 203*f*. The first portion 203*c* is co-extensive with an upper surface of the central area 203*b* and is arranged to partially overlap over the second portion 203*d*. As discussed in more detail below, when the base 202 is assembled together with the frame 204, the frame 204 engages with the channel 203*f* so as to hold the first portion 203*c* of the peripheral area 203*a*, while the second portion 203*d* extends under the frame 204. The structure and cross-section of the peripheral area 203*a* is shown in more detail in FIG. 6.

As shown in FIGS. 4-5B and FIG. 6, the first portion 203*c* includes cutouts 203*g* at each of the corners of the base so as to accommodate corner connectors 204*e* of the frame 204. In some embodiments, the second portion 203*d* has a stepped configuration so as to accommodate the shape of the frame 204 and to create a gapless appearance. In other embodiments, the second portion 203*d* of the peripheral area 203*a* may have a uniform thickness or may have a varying thickness, depending on the shape of the frame 204.

The frame 204 includes first, second, third and fourth side members 204*a*-204*d* each forming a sidewall of the frame 204, and four corner connectors 204*e* for connecting or joining adjacent side members 204*a*-204*d*, e.g., for joining the first side member 204*a* with the second side member 204*b* at one end and with the fourth side member 204*d* at the other end. Although the frame 204 in the present embodiment is rectangular including four sides, the invention may be adapted to doormats of different shapes and the frames of such doormats would be adapted to include the required number of side members and corners, e.g., for a hexagonal doormat, six side members and six corner members would be used to form the frame.

Figure 5A:
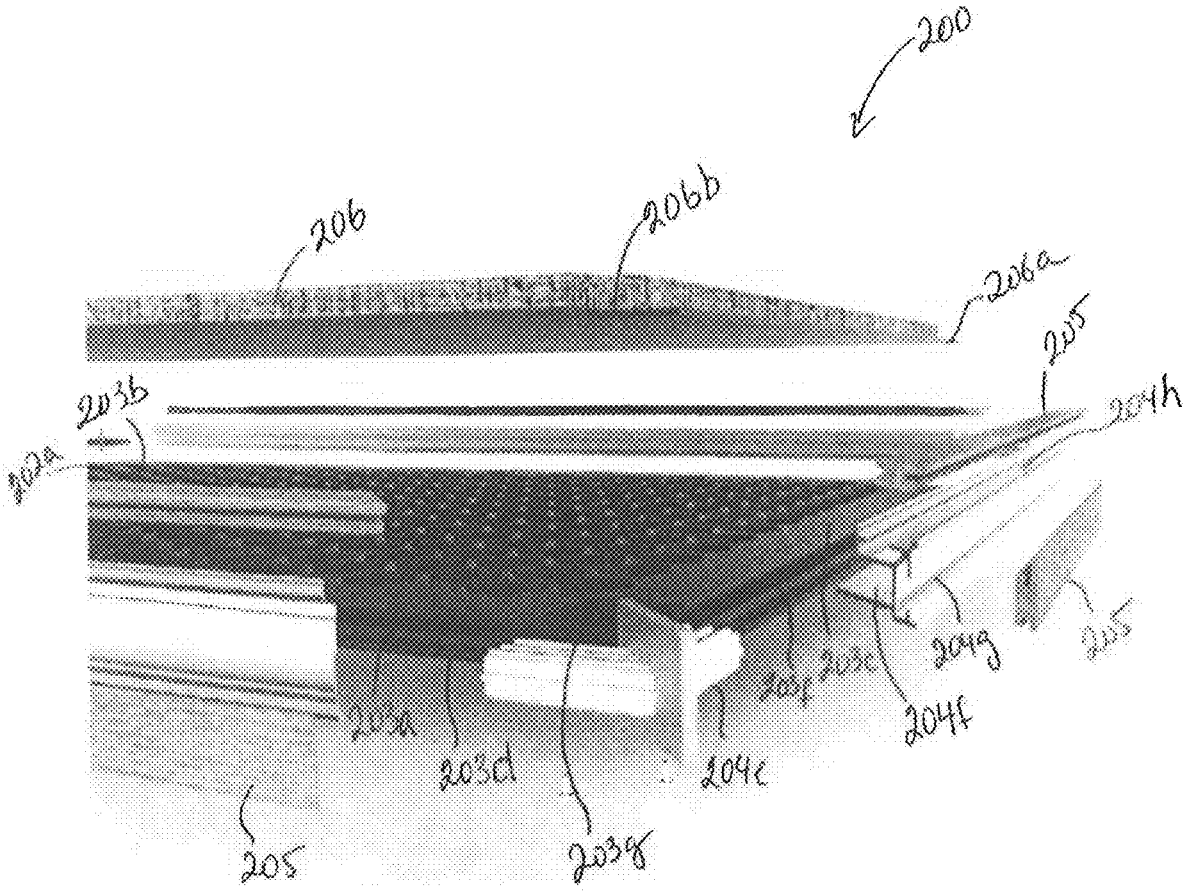
FIGS. 5A and 5B are further detailed views of the components of the doormat of FIGS. 3-4.
Figure 5B:
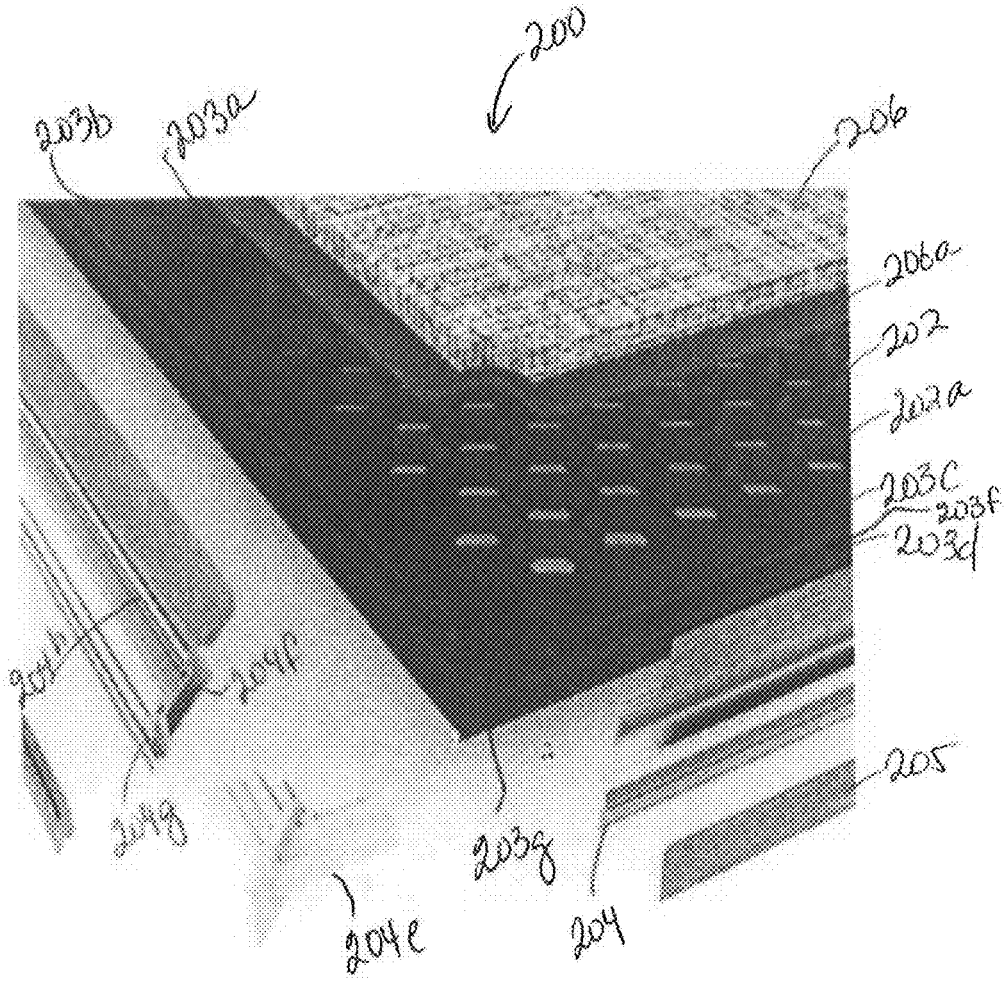
Figure 6:
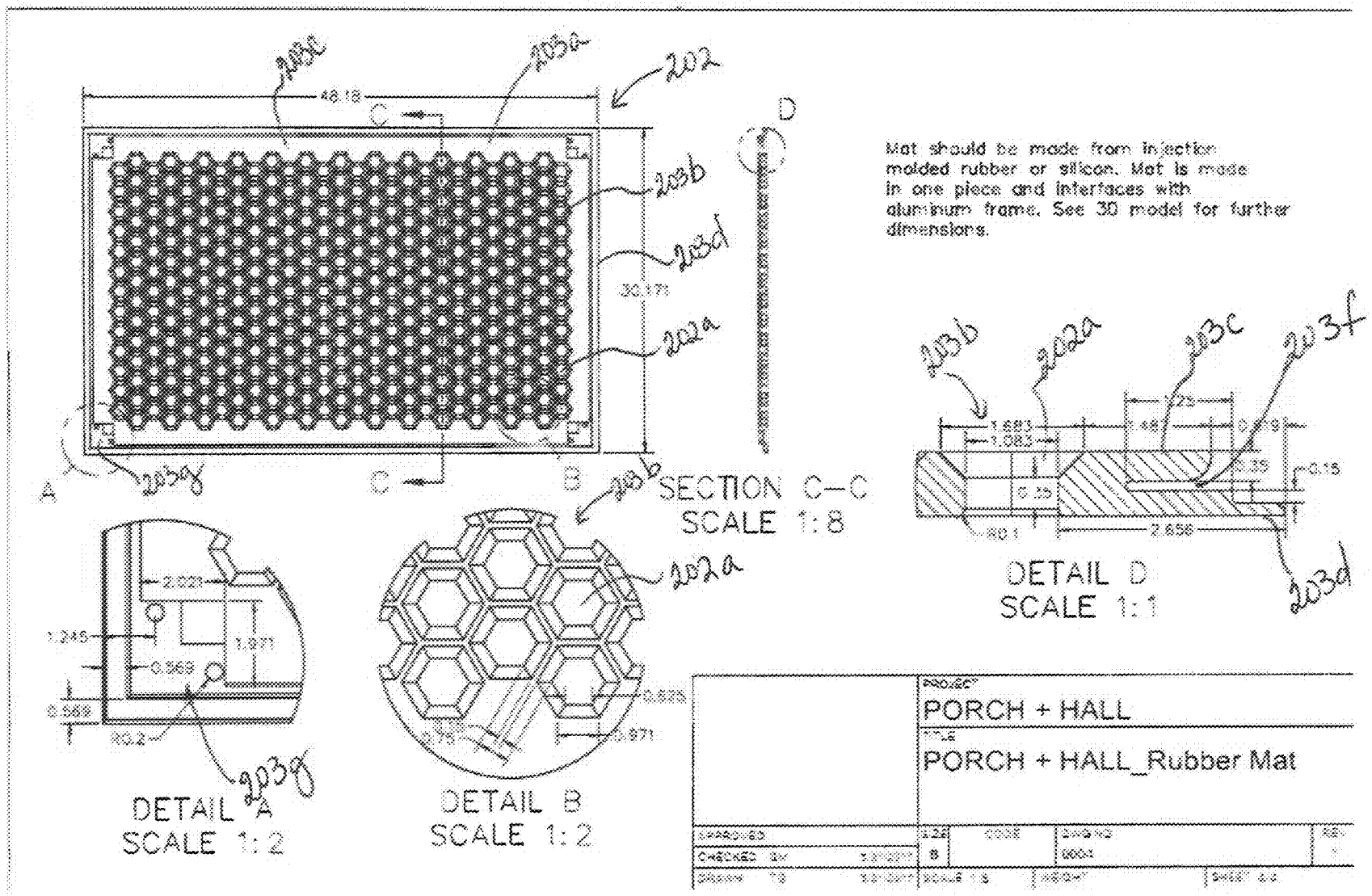
FIG. 6 shows more detailed views of the base of the doormat of the second embodiment.
Figure 7A:
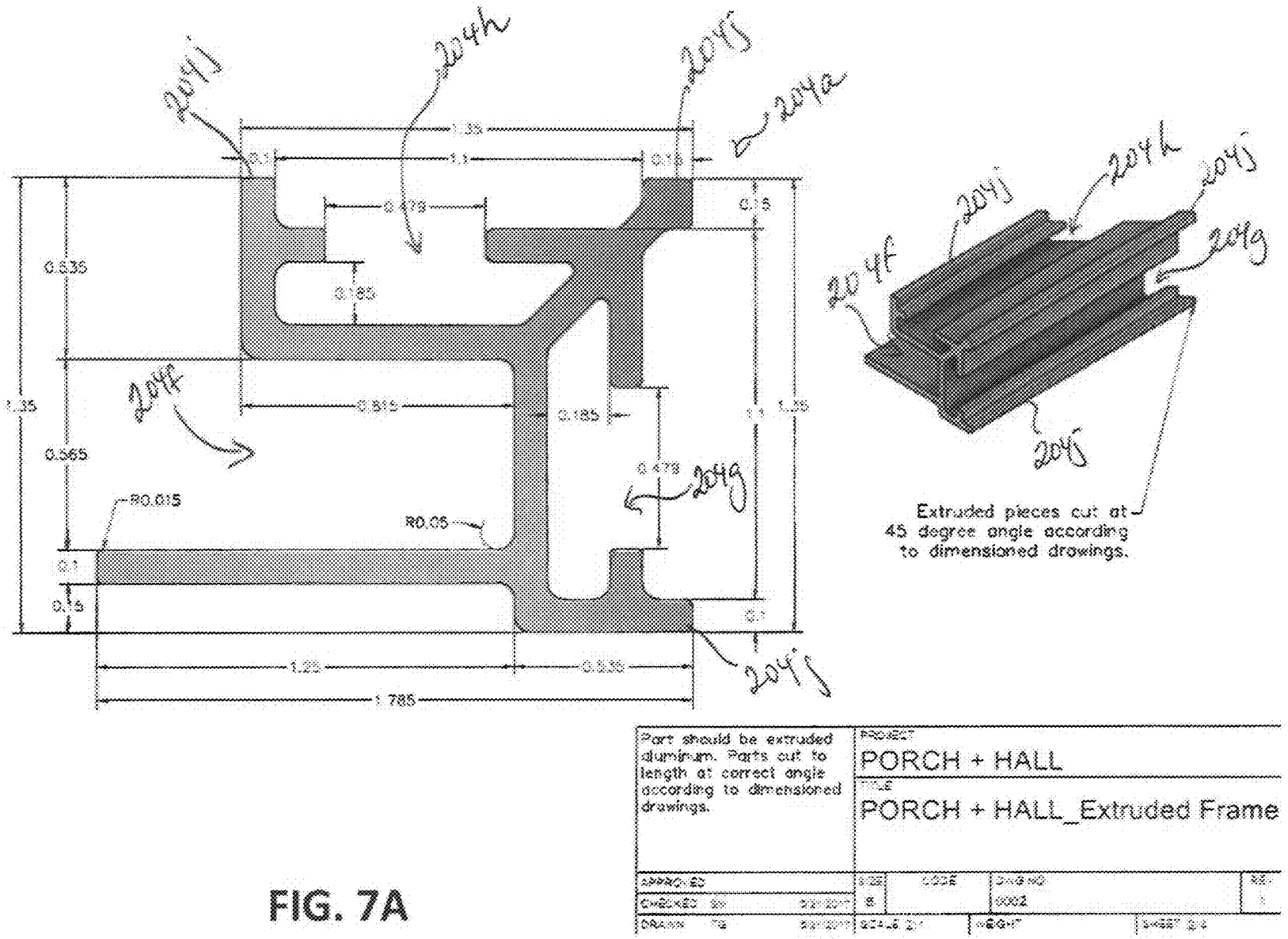
FIGS. 7A and 7B show more detailed views of the frame components of the doormat of the second embodiment.
Figure 8:
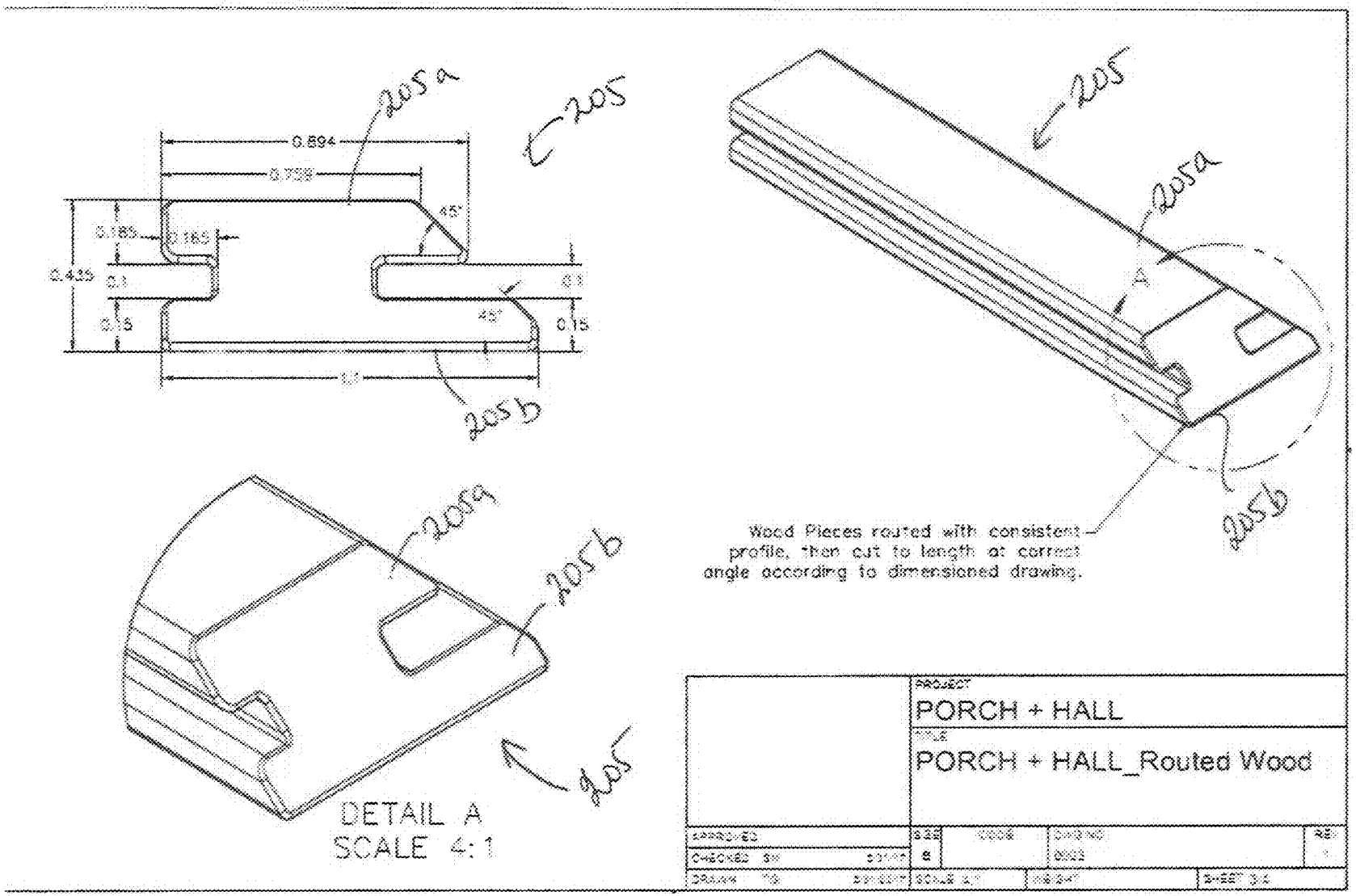
FIG. 8 shows more detailed views of decorative overlay of the doormat of the second embodiment.

As shown in FIG. 4 and visible in more detail in FIGS. 5A, 5B and 7A, each frame member 204*a*-204*d* comprises an elongated bar including a substantially rectangular U-channel 204*f* (also referred to as "main channel") for holding the first portion 203*c* of the peripheral area 203*a* of a corresponding side of the base 202. When the frame members are joined with one another to form the frame 204, the opening of the U-channel 204*f* of each frame member faces towards the center of the frame. When the frame 204 is assembled together with the base 202, the first portion 203*c* of the peripheral area 203*a* of each side of the base 202 is inserted into the main channel 204*f* of the corresponding frame member 204*a*-204*d* so that a lower leg of the main channel 204*f* is inserted into the channel 203*f* between the first and second portions 203*c* and 203*d* of the peripheral area 203*a* and the second portion 203 extends under the lower leg of the main channel 204*f*.

Each frame member 204*a*-204*d* also includes a first C-channel 204*g* with an opening that faces in an opposing direction from the opening of the main channel 204*f* and a second C-channel 204*h* with an opening that faces in a direction substantially perpendicular to the directions of the openings of the main channel and the first C-channel. When the frame members 204*a*-*d* are joined to form the assembled frame 204, the opening of the first C-channel 204*g* of each frame member forms a portion of an outer periphery of the frame 204 and faces away from the center of the frame 204, while the opening of the second C-channel 204*h* of each frame member faces in an upward direction and forms a portion of an upper surface of the frame. As shown in FIGS. 5A and 7A, the width of the first C-channel 204*g* may be greater than the width of the main channel 204*f*, wherein the first C-channel 204*g* extends beyond the lower leg of the main channel 204*f*. This illustrative configuration allows the first C-channel 204*g* to rest on the upper surface of the second portion 203*d* of the peripheral area. However, in other configurations, the width of the first C-channel 204*g* may be the same or similar to the width of the main channel 204*f*.

As shown in FIG. 7A, each side wall that extends from the main channel wall and forms a side of the first or second C-channel 204*g* and 204*h* may include a protrusion 204*j* extending beyond the periphery of the C-channel. These protrusions 204*j* co-extend with an outer surface of overlay 205 pieces which can be inserted into the first and second C-channels 204*g* and fill any gaps between overlay pieces 205 and other components of the doormat to create a gapless appearance.

In the illustrative embodiment of the present invention, a plurality of pieces of decorative overlay 205 engage with the first and second C-channels 204*g* and 204*h* of each frame member 204*a*-204*d* via a T-shaped protrusion 205*a* formed on a surface of the decorative overlay 205. Specifically, the T-shaped protrusion 205*a* of the decorative overlay 205 is adapted to slide into, and to engage with, the corresponding C-channel 204*g* or 204*h*.

FIG. 8 shows the configuration of the decorative overlay 205 in more detail. As shown in FIG. 8, the decorative overlay 205 includes an outer portion 205*b* with the T-shaped protrusion 205*a* provided on its surface. In the illustrative configuration shown in FIG. 8, the decorative overlay 205 is not symmetrical with a first side of the overlay 205 being longer than a second side and the first side of the overlay being cut at an angle. The angle at which the first side is cut matches the angle of the corresponding C-channel 204*g* or 204*h*. In this illustrative example, the angle is 45 degrees, but in other configurations, the angle may be different.

Figure 7B:
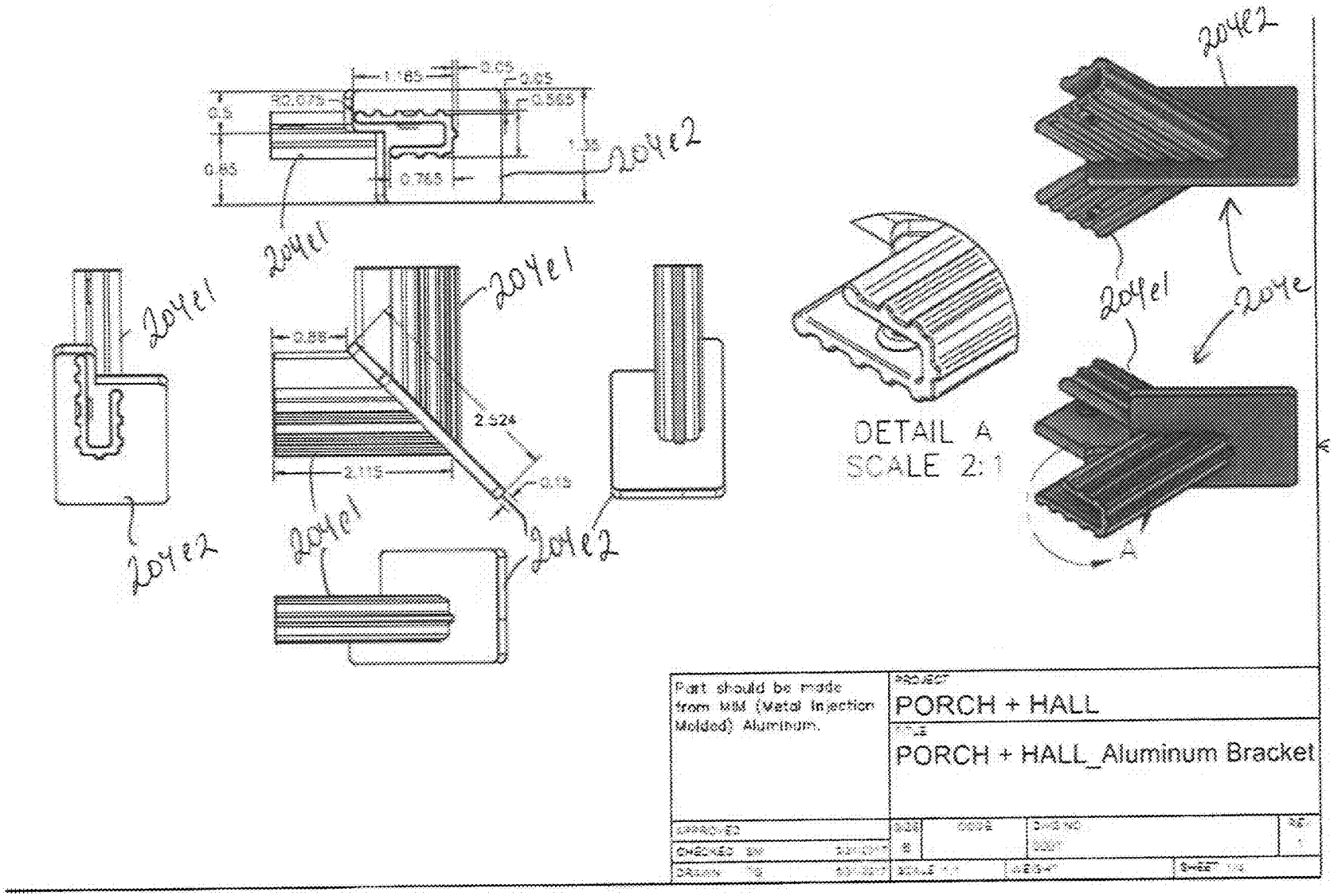

As discussed above, the frame 204 also includes four corner connectors 204*e* for joining adjacent frame members 204*a*-204*d* with one another. FIG. 7B shows a detailed view of each corner connector 204*e*. Each corner connector 204*e* has an L shape with legs 204*e*1 of substantially the same length. A substantially rectangular plate 204*e*2 extends from a corner of the corner connector 204*e* between the legs of the corner connector 204*e*.

To assemble the frame 204, the legs of each corner connector 204*e* are inserted into the main channels 204*f* of the respective adjacent frame members 204*a*-204*d* so as to join the adjacent frame members with one another. Moreover, when the frame 204 is assembled with the base 202, each corner connector 204*e* is positioned in the cutout 203*g* of the first portion 203*c* of the peripheral area 203*a* and is secured to the second portion 203*d* of the peripheral area 203*a* using fasteners, such as screws or other suitable fasteners. In the assembled frame, the rectangular plate provided between the legs of the corner connector 204*e* fills a space formed at the corner between adjacent frame members 204*a*-204*d*, thereby providing a gapless appearance.

In the present illustrative embodiment, the above-described components of the frame 204 are made from metallic materials such as steel, stainless steel, aluminum, chromium, nickel, copper, titanium and other metals that are preferably rust resistant, and combinations thereof. In other embodiments, other materials which are sufficiently strong and durable may be used for the frame, including certain plastics and polymers, resins, etc. In the present illustrative embodiment, the components of the frame 204 comprise stainless steel and may be formed by extrusion and/or metal injection molding (MIM). For example, the frame members 204*a*-204*d* may be formed from extruded steel and finished with a radial arm saw and a drill to accept the screws, while the corner connectors 204*e* may be formed by metal injection molding (MIM). However, it is understood that other techniques, including cutting, welding and 3-D printing, may be used for forming frame components.

The plurality of pieces of decorative overlay 205 may be formed from any suitable materials, including wood, plastics, polymers, metal, etc. so as to create a desired appearance. In the present illustrative embodiment, the decorative overlay 205 pieces are formed from treated or untreated wood, such as teak, cedar, cypress, etc., or from bamboo, and may be created on a router table or using a table saw and finished with a radial arm saw.

As discussed above, the doormat also includes a removable center insert 206 which can be inserted into the frame and base assembly and removed therefrom for cleaning or replacement. The removable center insert 206 may be formed from any suitable material with brushing ability, including but not limited to coir, jute, horsehair, bristles, polypropylene, etc. In the illustrative embodiment shown in FIGS. 4-5B, a thin layer 206*a* made from rubber or other non-slip material is used to form a bottom surface of the removable center insert 206 so as to hold the removable center insert 206 in place and to prevent slipping or bunching. In the present illustrative embodiment, the shape of the removable center insert 206 is similar to the opening in the frame, and cutouts 206*b* are formed at one or more corners of the removable center insert 206 to allow for easy removal or lifting of the removable center insert 206 from the frame 204 and base 202 assembly.

Figure 11:
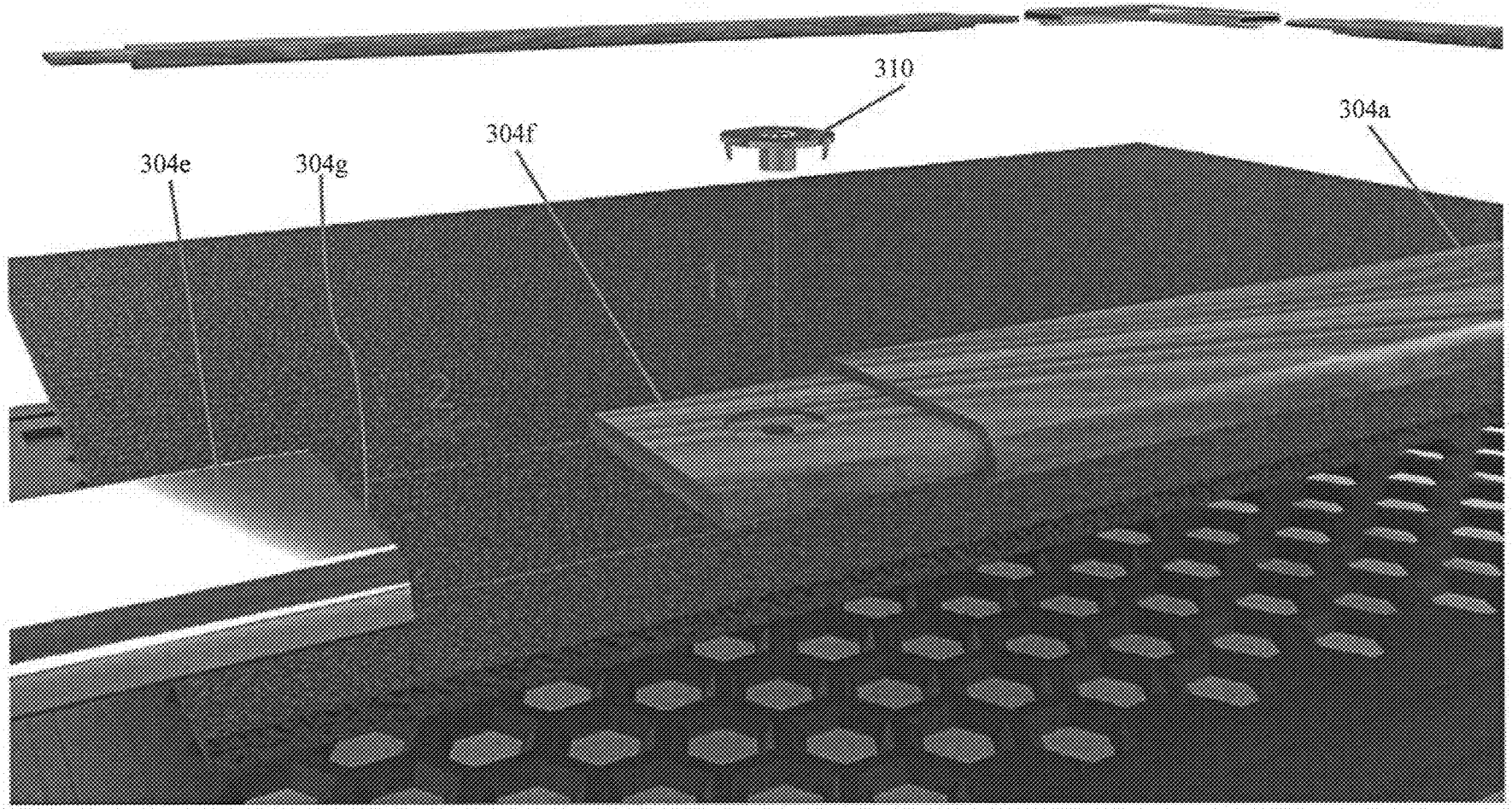
FIGS. 11 and 12 show details of assembling the doormat of FIG. 9.
Figure 12:
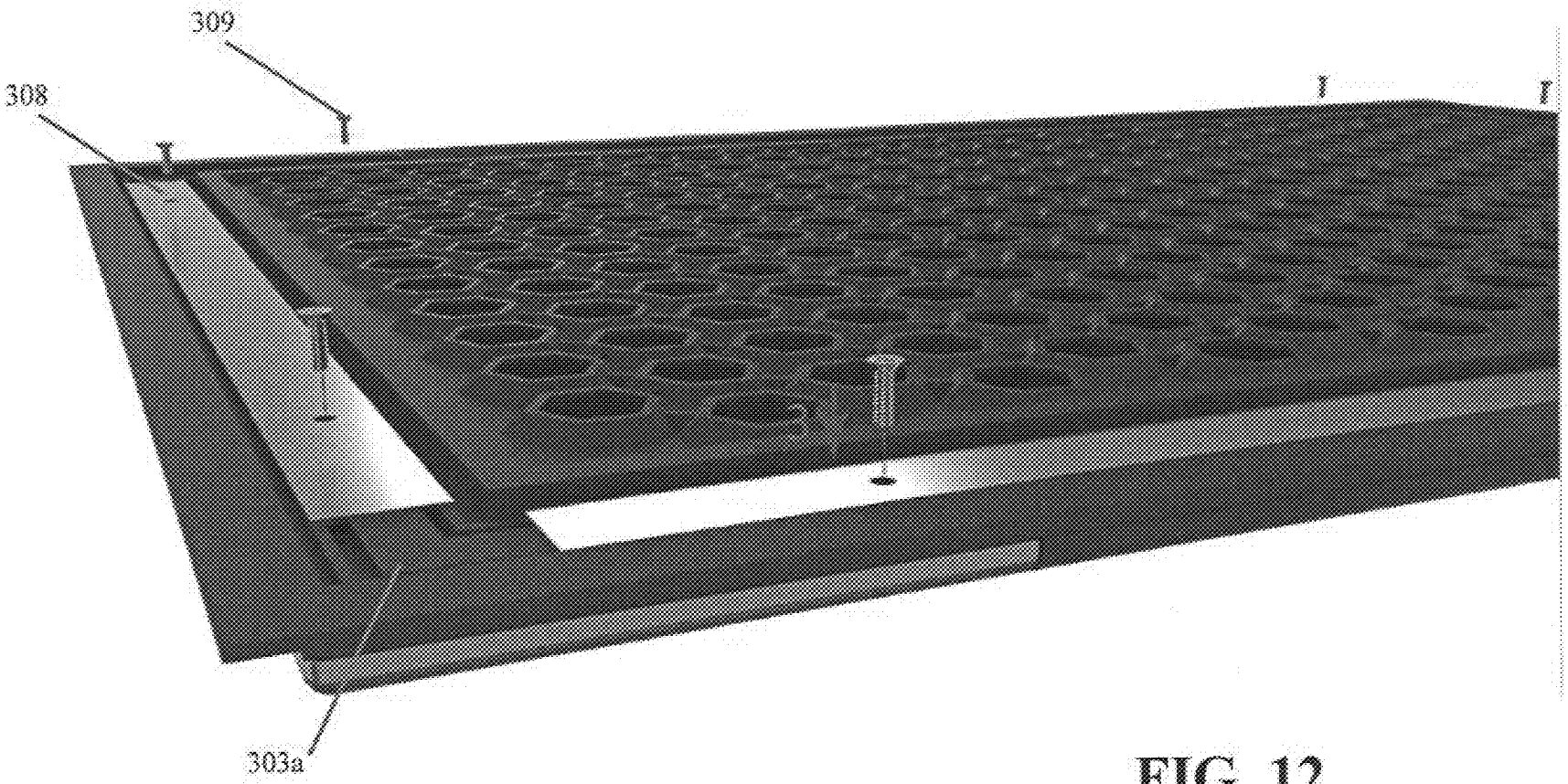

FIGS. 9-17B show the third embodiment of the doormat 300 of the present invention. FIG. 9 shows an assembled configuration of the doormat 300, while FIGS. 10A and 10B show exploded views of the doormat components viewed from above and from below, respectively. FIGS. 11 and 12 show details of assembling the doormat 300 of FIGS. 9-10B, and FIGS. 13A-17B show more detailed configurations of the individual components of the doormat 300, including the configurations of a base 302 in FIGS. 13A-C, corner members 304*e* of the frame 304 in FIGS. 14A-14C, side members 304*a*-*d* of the frame 304 in FIGS. 15A-15C, support brackets 308 in FIG. 16, and tee nut connectors in FIGS. 17A-B. These features and components of the doormat 300 are described in more detail below.

In the third embodiment, the doormat 300 includes the base 302, the frame 304 provided on an upper surface of the base 302 and support brackets 308 provided on a lower surface of the base 302. The frame 304 and the support brackets 308 are each engaged with the base 302 and are engaged with one another using connectors or another suitable coupling mechanism so that an outer periphery of the base 302 is sandwiched between the frame 304 and the support brackets 308. The doormat 300 also includes a removable center insert 306 which can be removed for cleaning or exchanging with other removable center inserts.

In the illustrative embodiment shown in FIGS. 9 and 10A-10B, the base 302 is made of rubber using injection molding, and preferably from eco-rubber or silicon. In one illustrative embodiment, the base 302 is made from nitrile-butadiene rubber (NBR), styrene-butadiene rubber (SBR) or a mix of NBR/SBR rubber. However, in other embodiments, the base 302 may be formed from other materials including plastic, resins or any other suitable heavy-duty materials, or a combination thereof, which are waterproof and can withstand wet conditions and maintain durability and stability at a large range of temperatures ranging from below freezing to above 100° F.

Figure 13A:
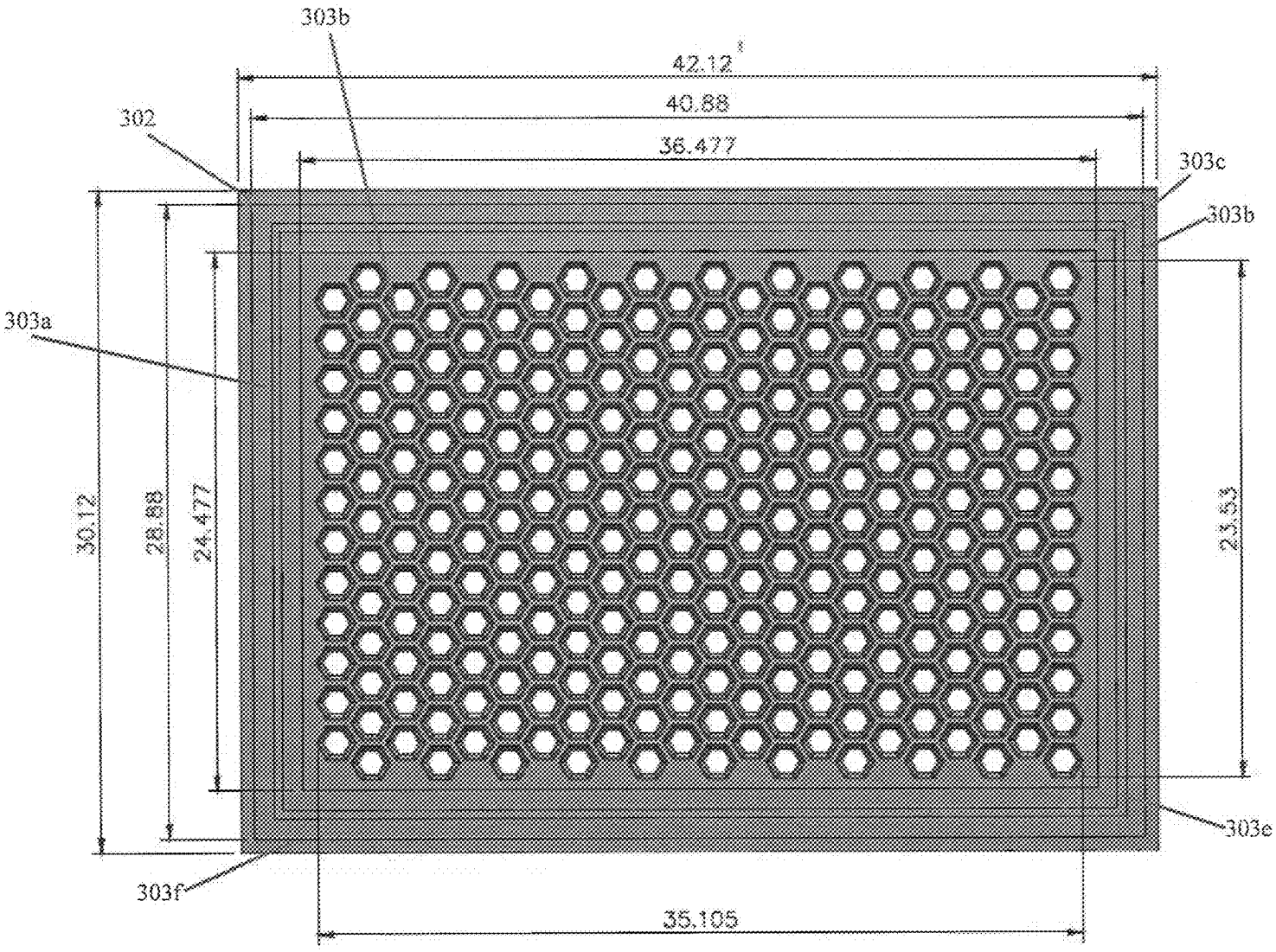
FIGS. 13A-13C show in more detail a base of the doormat of FIG. 9.
Figure 13B:
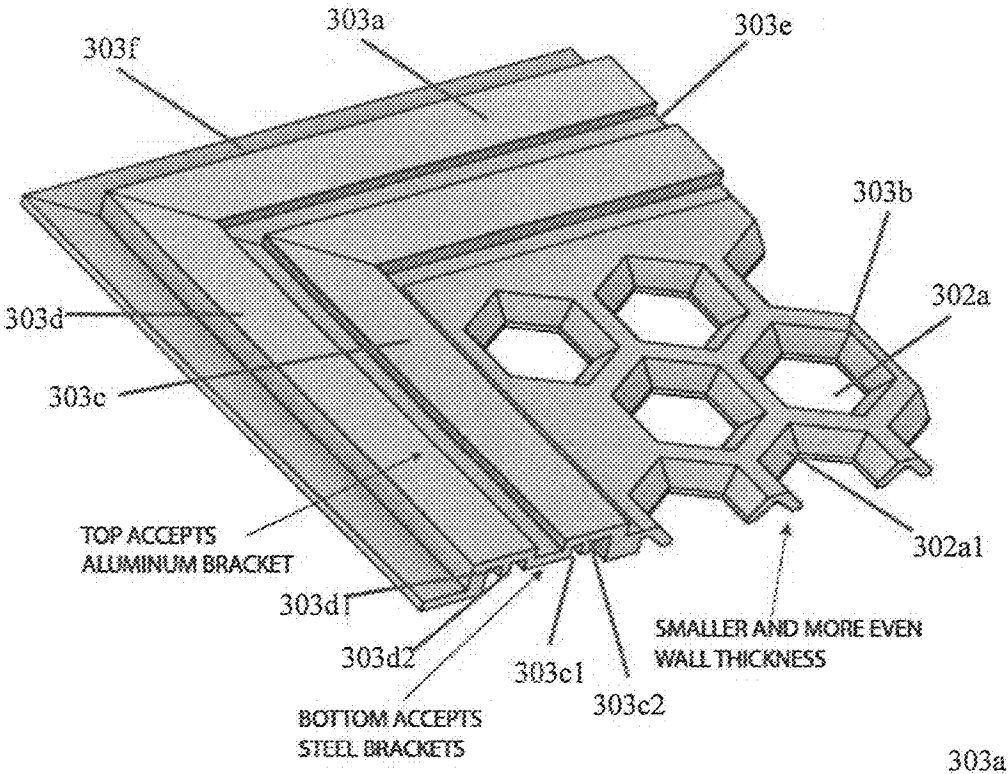
Figure 13C:
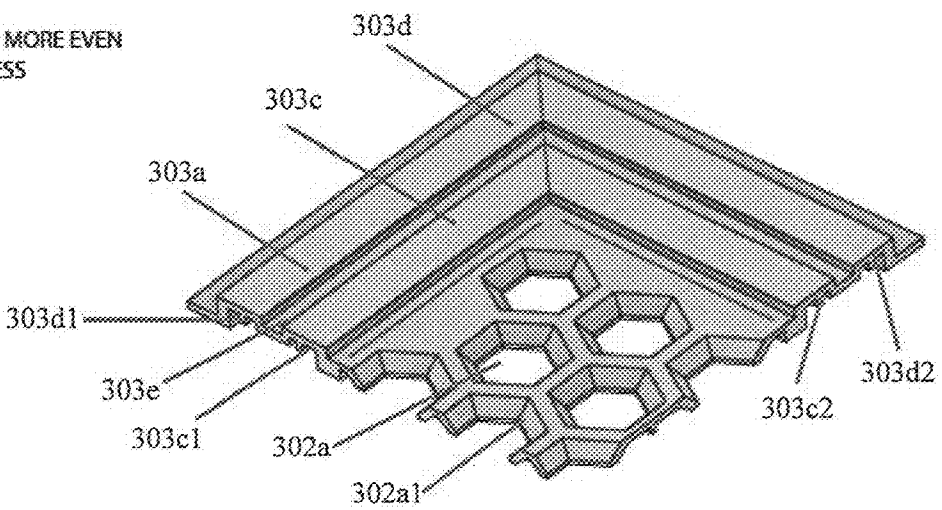

FIGS. 10A and 10B show exploded views of the doormat 300 shown in FIG. 9 viewed from the upper surface and from the lower surface, respectively. As shown in FIGS. 10A-B, the base includes a peripheral area 303*a* extending around a periphery of the base 302 and a central area 303*b* surrounded by the peripheral area 303*a*. In the embodiment shown, the central area 303*b* includes a plurality of openings 302*a* which provide drainage for fluids trapped by the doormat. In the illustrative embodiment of FIGS. 10A-B, the openings have a hexagonal shape and are arranged at uniform intervals throughout the central area 303*b*. The specific configuration of the central area 302*b* and the openings 302*a* is shown in FIGS. 13A-C and described in more detail below. However, as in the other embodiments, the shape of the openings 302*a* may be varied (e.g., circular, rectangular, etc.) and the density of the openings in the central area 303*a* may also be varied. In yet other embodiments, the base 302 may have a solid construction without any openings, particularly for doormats that are intended for use indoors.

As shown in FIG. 10A, the upper surface of the peripheral area 303*a* includes an inner frame-shaped protrusion 303*c* surrounding the central area 303*b* of the base 302 and an outer frame-shaped protrusion 303*d* surrounding the inner frame-shaped protrusion 303*c*. The inner and outer protrusions 303*c*, 303*d* are separated by a channel 303*e* therebetween, and the outer frame-shaped protrusion is surrounded by an outer lip 303*f* forming the outer periphery of the base 303.

The configuration of the upper surface of the peripheral area 303*a* is adapted for engaging with the frame member 304, which includes four side members 304*a-d* forming the respective sides of the frame member 304, and four corner connectors or corner members 304*e* forming the respective corners of the frame member 304. Each of the four side members 304*a-d* has a T-shaped cross-section, wherein each side member 304*a-d* comprises a bar with a central elongated projection provided along the length of its lower surface. The elongated projection is configured to fit within the channel 303*e* formed in the between the inner and outer frame-shaped protrusions 303*b*, 303*c* on the base member. Similarly, each of the four corner members 304*e* has a T-shaped cross section, wherein each corner member comprises two bars extending perpendicularly with respect to one another and a central elongated projection provided along the length of the lower surface of each bar. The elongated projection of each corner member 304*e* is configured to fit within the channel 303*e* formed between the inner and outer frame-shaped protrusions 303*b*, 303*c* in the corner areas of the base member 302.

As also shown in FIG. 10A, each of the side members 304*a-d* includes a recessed end 304*f* and each of the corner members includes an opening 304*g* at each end so that the recessed end 304*f* of the respective side member 304*a-d* is inserted into an opening in an adjacent end of the respective corner member 304*e*. In this way, the side members 304*a-d* engage with the corner members 304*e* to form the frame 304. When the frame member 304 is engaged with the base 302 by inserting the elongated projections on the frame member 304 into the channel 303*e* formed in the base 302, the outer lip 303*f* of the base member 302 extends beyond the periphery of the frame member 304. In the illustrative embodiment of FIGS. 9-10B, the outer lip 303*f* has a smaller thickness than the rest of the peripheral area 303*a* of the base 303. However, in other embodiments, the thickness of the lip may be varied and for example, may be similar to the thickness of the rest of the peripheral area. The outer lip 303*f* provides gripping around the periphery of the doormat 300 so that the doormat is prevented from moving relative to the floor.

As shown in FIG. 10B, the lower surface of the base member 302 is configured to accommodate support brackets 308 that extend along each side of the peripheral area 303*a*. In the embodiment of FIG. 10B, the lower surface of the peripheral member 303*a* includes a frame-shaped recess 303*g* or channel that is configured to accommodate the support brackets 308 therein. The depth of the recess 303*g* is preferably the same or larger than the thickness of the support brackets 308. In one example, each of the support brackets is a metallic bar-shaped bracket, preferably formed from stainless steel or another suitable water resistant metallic material. In other embodiments, the support brackets may be formed from non-metallic materials having sufficient strength so as to prevent bending of the doormat and to provide structural support to the doormat 300.

As shown in FIGS. 10A and 10B, connectors including screws 309 and tee nuts 310 are provided for coupling the frame member 304 with the support brackets 308 so that the peripheral area 303*a* of the base member 302 is sandwiched between the frame 304 and the support brackets 308. In the present illustrative embodiment, the tee nuts 310 are inserted into respective openings provided in the recessed ends 304*f* of the frame side members 304*a-d*, as shown by an arrow 1 in FIG. 11, and thereafter the recessed ends 304*f* of the side members 304*a-d* are inserted into corresponding openings 304*g* in the corner members 304*e*, as shown by an arrow 2 in FIG. 11. This configuration positions the tee nuts 310 in the respective openings in the recessed ends 304*f* and holds the tee nuts 310 in those openings, while also hiding the tee nuts 310 from view when the frame member 304 is assembled. As a result, a seamless appearance of the frame member 304 is possible. The screws 309 are then passed through corresponding openings in the support brackets 308, the openings in the peripheral area 303*a* of the base member 302 and the openings in the recessed ends 304*f* so that each screw 309 engages with a respective tee nut 310. The insertion of the screws is shown in FIG. 12 by an arrow 3.

The combination of the frame member 304 and the support brackets 308 in this embodiment replaces the frame 204 of the second embodiment shown in FIGS. 3-5B. In the illustrative third embodiment shown in FIGS. 9-10B, the side members 304*a-d* are formed from natural materials, such as wood (e.g., Ipe, teak, walnut, etc.) or bamboo, and the corner members 304*e* are formed from metallic materials, such as aluminum, steel, stainless steel, nickel, copper, chromium, titanium and other metals that are preferably rust resistant or treated to be rust resistant, or from other materials such as plastics, polymers or composite materials, and have a metallic finish applied thereto. However, in other embodiments, the materials used for the side members 304*a-d* and the corner members 304*e* may be varied, depending on the design requirements of the frame. For example, the side members 304*a-d* may be formed from metal, plastics, polymers, composite materials or any other suitable materials, and if desired, a coating may be applied to the side members 304*a-d* to achieve a desired appearance. Similarly, the corner members 304*e* may be formed from other materials, including wood, plastics, polymers, composite materials or any other suitable materials for the design, and may include a coating to achieve a desired appearance.

Moreover, in the third embodiment, the side members 304*a-d* have the recessed ends 304*f* while the corner members 304*e* have the openings 304*g* into which the recessed ends are inserted. In other configurations, the corner members 304*e* may instead have the recessed ends which are insertable into openings formed in the side members 304*a-d*. This configuration may be desirable, for example, if the corner members are formed from wood and the side members are formed from metal, plastic, polymer or composite materials.

Furthermore, in the illustrative embodiment of FIGS. 9-10B, the materials selected for the side members 304*a-d* and the corner members 304*e* are dependent on the desired appearance of the doormat 300. In some embodiments, the materials for the side members 304*a-d* and corner members 304*e* may be selected without regard to appearance, and as in the second embodiment, a plurality of pieces of decorative overlay may be used for engaging with the side members 304*a-d* and the corner members 304*e* to provide a desired appearance. The mechanism for engagement between the decorative overlay and the frame member 304 may be similar to the mechanism described in the second embodiment, or may be any other suitable mechanism, including use of adhesives, stapling, or any other suitable coupling.

As discussed above, the doormat 300 includes a removable center insert 306 which can be inserted into the frame and base assembly and removed therefrom for cleaning or replacement. The removable center insert 306 may be formed from any suitable material with brushing ability, including but not limited to coir, jute, horsehair, bristles, polypropylene, etc. In some embodiments, a thin layer made from rubber or other non-slip material is used to form a bottom surface of the removable center insert 306 so as to hold the removable center insert 306 in place and to prevent slipping or bunching. In the present illustrative embodiment, the shape of the removable center insert 306 is similar to the central opening in the frame member 304. As in the second embodiment, one or more cutouts may be formed at one or more corners of the removable center insert 306 to allow for easy removal or lifting of the removable center insert 306 from the frame member 304 and base 302 assembly.

FIGS. 13A-13C show a more detailed view of the base 302 and the configurations of the peripheral area 303*a* and central area 303*b* of the base. FIG. 13A shows a view of the whole base 302 viewed from the upper surface, and FIGS. 13B and 13C show cut-away views of the base 302 to illustrate in more detail the structure of the base 302. The base 302 is formed from a rubber or polymer material, which may be a mixed NBR/SBR rubber material. In the present illustrative embodiment, the base 302 is molded using a 2-piece mold. However, in other embodiments, other techniques, including 3-D printing, may be used for forming the base 302.

As shown in FIG. 13A and as discussed above, the upper surface of the peripheral area 303*a* includes the inner frame-shaped protrusion 303*c* surrounding the central area 303*a* and the outer frame-shaped protrusion 303*d* surrounding the inner frame-shaped protrusion 303*c* and separated from the inner frame-shaped protrusion 303*c* by the channel 303*e*. The outer lip 303*f* extends from the outer frame-shaped protrusion around the periphery of the base 302. As also shown in FIG. 13A and described above, the central area includes a plurality of openings 302*a*, which are hexagonal in shape in the present illustrative embodiment.

As shown in more detail in the cut-away views of FIGS. 13B and 13C, the central area 303*b* has a substantially uniform thickness and each of the openings 302*a* in the central area 303*b* has a beveled edge or chamfered edge 302*a*1 when viewed from the upper surface. As can be seen in FIG. 13B, the beveled edges 302*a*1 of adjacent openings 302 create corresponding V-shaped channels on the lower surface of the central area 303*b* and the walls between adjacent openings 302 have a substantially chevron-shaped cross-section. In the peripheral area 303*a* of the present illustrative embodiment, the walls forming the inner and outer frame-shaped protrusions 303*c*, 303*d* and the channel 303*e* therebetween have substantially the same or similar thickness, so that the frame-shaped protrusions 303*c*, 303*d* form corresponding channels 303*c*1, 303*d*1 on the lower surface of the peripheral area 303*a*. As shown in FIGS. 13B and 13C, the depth of the channel 303*e* is smaller than the height between the outer lip 303*f* and the upper surface of each frame-shaped protrusion 303*c*, 303*d*. In this way, the frame-shaped recess is formed on the lower surface of the peripheral area 303*a* between the outermost wall of the outer frame-shaped protrusion 303*d* and the innermost wall of the inner frame-shaped protrusion 303*c*. In addition, in the present exemplary invention, each of the channels 303*c*1, 303*d*1 on the lower surface of the peripheral area 303*a* can include a rib 303*c*2, 303*d*2 extending lengthwise therein in order to provide structural support for the peripheral area 303*a*. The ribs 303*c*2, 303*d*2 may also define edges that prevent lateral movement of the support brackets 308. The above-described construction of the base 302 as shown in FIGS. 13B and 13C provides flexibility and elasticity to the base 302, particularly in the central area 303*b*, allows the base to withstand repeated placement of heavy loads thereon, and reduces the weight of the base 302 and the amount of materials required for manufacturing the base.

Figure 14A:
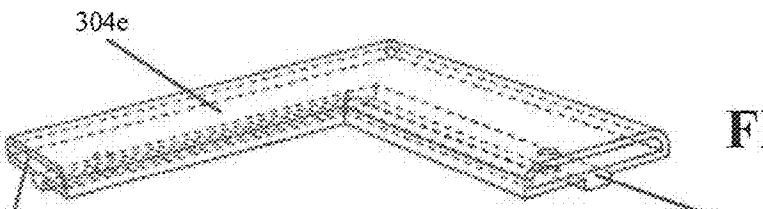
FIGS. 14A-14C show in more detail corner members of the frame of the doormat of FIG. 9.
Figure 14B:
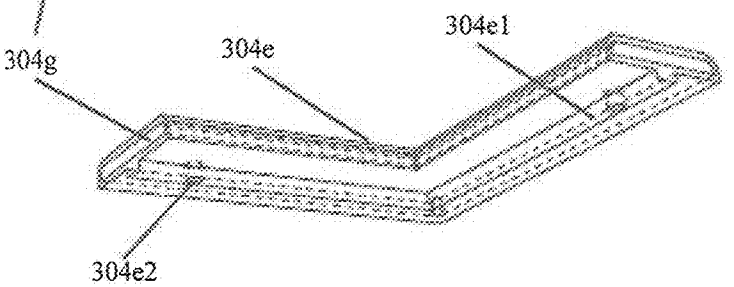
Figure 14C:
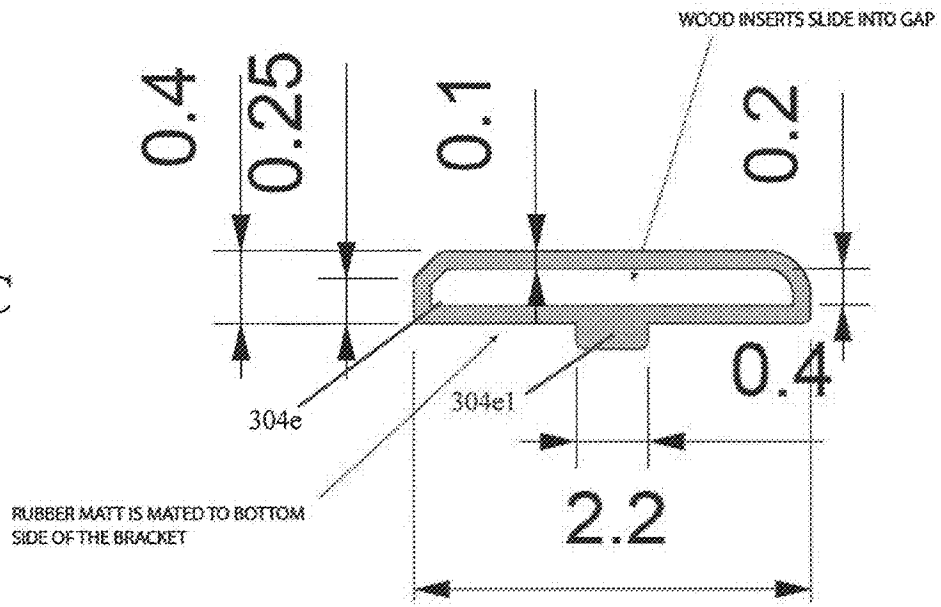

FIGS. 14A-14C show a more detailed view of the construction of the corner members 304*e* of the frame 304. As shown in FIGS. 14A-14C, the corner members 304*e* of the present illustrative embodiment have a hollow or a partially hollow construction, wherein each corner member 304*e* has an opening 304*g* at each end. Each opening 304*g* is used for inserting a corresponding recessed end of the frame member 304*a-d* therein in order to couple the frame members 304*a-d* with the corner members 304*e*. Each of the corner members 304*e* has a substantially rectangular cross-section and may have rounded corners on the upper surface thereof. In addition, each corner member 304*e* includes a rib or protrusion 304*e*1 extending lengthwise along its lower surface, which is sized to fit into the channel 303*e* formed in the peripheral area 303*a* of the base. Moreover, as shown in FIGS. 14A-14B, the lower surface of each corner member includes at least one opening 304*e*2 near each end thereof for engaging with connectors 309, 310 that are passed through corresponding openings in the frame members 304*a-d*, the support brackets 308 and/or the base member 302. As discussed above, the corner members 304*e* may be formed from metallic materials, such as aluminum, e.g., 6061-T6 aluminum, stainless steel, chrome, nickel, etc., or from any other suitable materials depending on the desired appearance of the frame, including, but not limited to resin, plastics, polymers, wood, etc. In certain embodiments, corner members 304*e* may have a finish or coating applied thereto, such as an anodized, polished or powder coated finish applied to aluminum corner members.

Figure 15A:
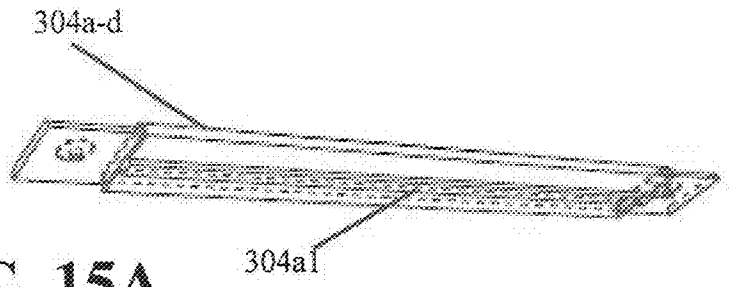
FIGS. 15A-15C show in more detail side members of the frame of the doormat of FIG. 9.
Figure 15B:
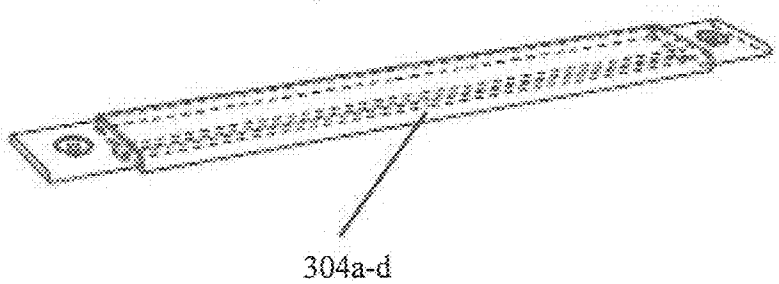
Figure 15C:
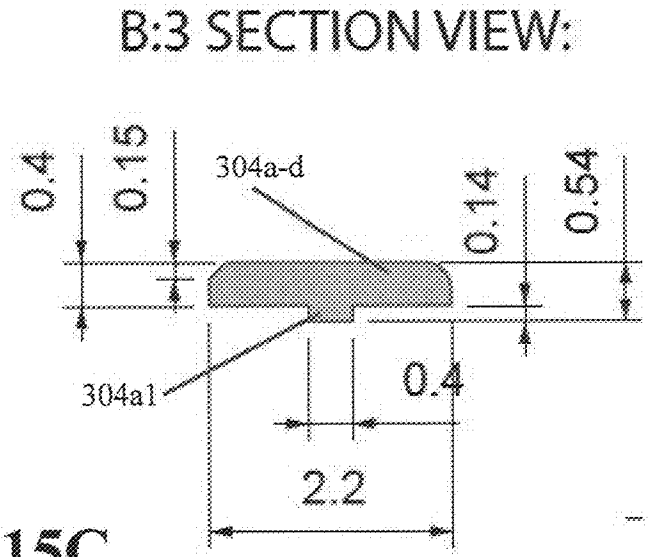

FIGS. 15A-15C show a more detailed view of the construction of the frame members 304*a-d* of the frame. In the illustrative embodiment of FIGS. 15A-15C, each of the frame members has main body and recessed ends, and each frame member 304*a-d* has a solid construction. The main body of the frame member 304*a-d* has a substantially rectangular cross-section, which is preferably substantially the same as the cross-section of the corner members 304*e* in order to provide a smooth and continuous appearance between the frame members 304*a-d* and the corner members 304*e*. As shown in FIGS. 15A and 15C, the lower surface of each frame member 304*a-d* includes a rib or protrusion 304*a*1 extending along the length of its main body. The recessed ends of the frame members 304*a*-304*d* may also have a substantially rectangular cross-section and are adapted to be inserted into the corresponding openings in the adjacent corner members 304*e*. As shown in FIGS. 15A-15B, each of the recessed ends of the frame members 304*a-d* includes an opening that allows the connectors 309, 310 to pass through in order to couple the support brackets 308, the base 302, the frame members 304*a-d* and the corner members 304*e* together. The openings in the recessed ends are countersunk in order to accommodate the tee nut connectors 310.

In the illustrative embodiments shown in FIGS. 15A-15C, the frame members 304*a-d* are formed from wood, such as teak, walnut, cedar, or any other wood that is preferably decay and water resistant, or from bamboo. The frame members 304*a-d* may have a finish or coating applied thereto, such as a clear matte polyurethane finish. In other embodiments, the frame members 304*a-d* may be formed from other materials, such as plastics, polymers, resins, metals, etc., in order to provide a desired appearance.

As discussed above, although in the present illustrative embodiment, the frame members 304*a-d* have recessed ends that are inserted into corresponding openings in the corner members 304*e*, in other embodiments, the frame members 304*a-d* may be configured to have openings formed at their ends instead of the recessed ends, and the corner members 304*e* may be configured to include recessed ends for inserting into the openings in the frame members 304*a-d*. In yet other embodiments, other means of connecting the frame members 304*a-d* and corner members 304*e* may be used. In further embodiments, the frame 304 may be formed as single integral piece so as to eliminate the need for connecting separate pieces that form the frame.

Figure 16:
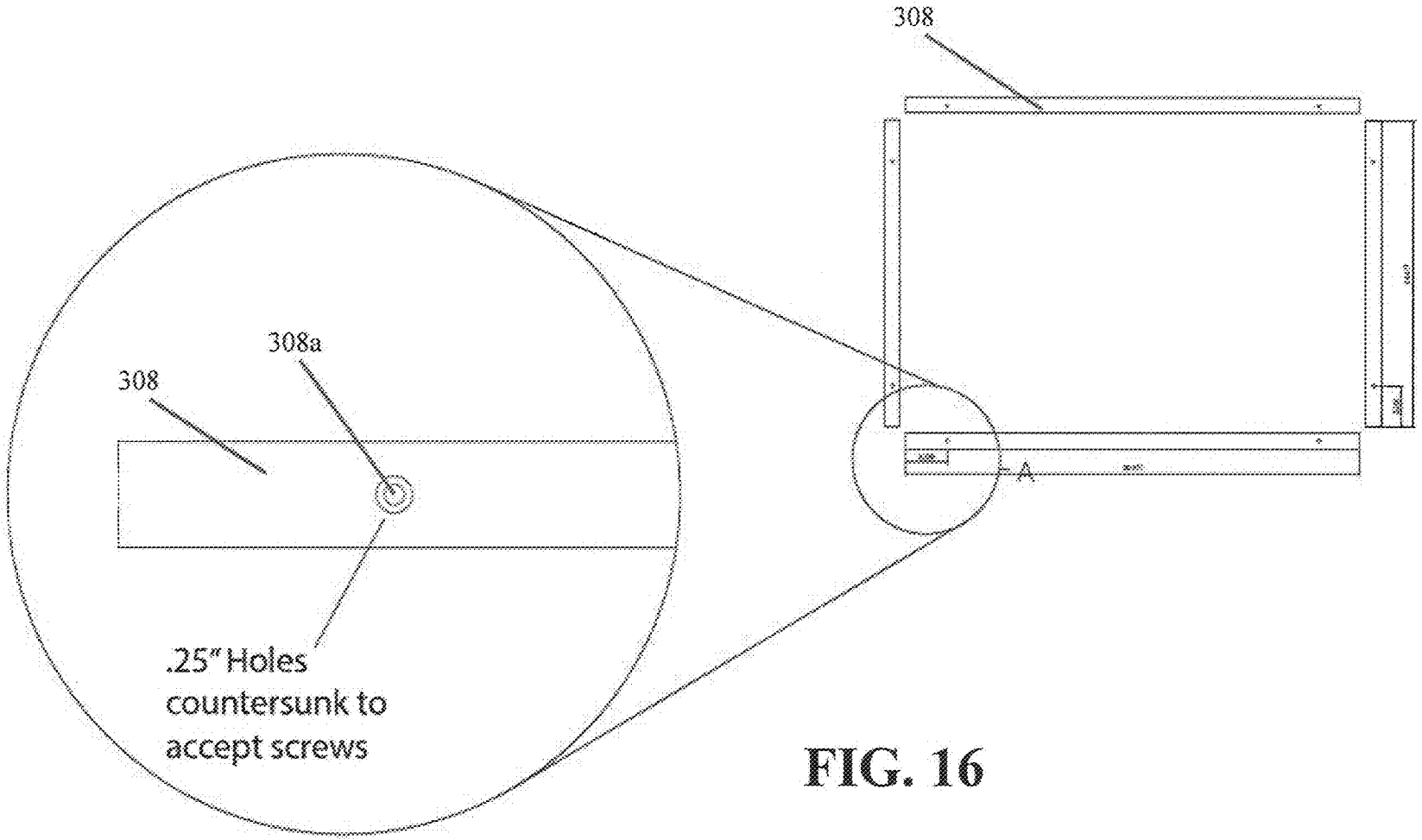
FIG. 16 shows in more detail support brackets of the doormat of FIG. 9.

FIG. 16 shows a more detailed view of the support brackets 308 of the doormat. In FIG. 16, each bracket 308 is formed as a metallic bar or beam, which has a relatively small thickness, e.g. about 0.125 inch. For example, each support bracket 308 may be cut from a 1.5 inch wide steel bar with a 0.125 inch thickness. The support brackets 308 may be formed from stainless steel, e.g., 10 gauge stainless steel, aluminum, e.g., 6061-T6 aluminum, or from other metallic or non-metallic materials with sufficient strength. In the illustrative embodiment of FIG. 16, each support bracket 308 includes an opening near each end of the bracket 308 through which the connector screws 309 are passed. The openings in the support brackets 308 are countersunk in order to accept the screws 309 and to make the tops of the screws flush with the surface of the support brackets 308.

Figure 17B:
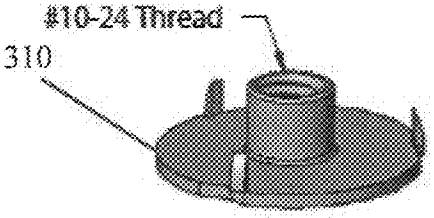
FIGS. 17A-17B show in more detail tee nut connectors used for assembling the doormat of FIG. 9.
Figure 17A:
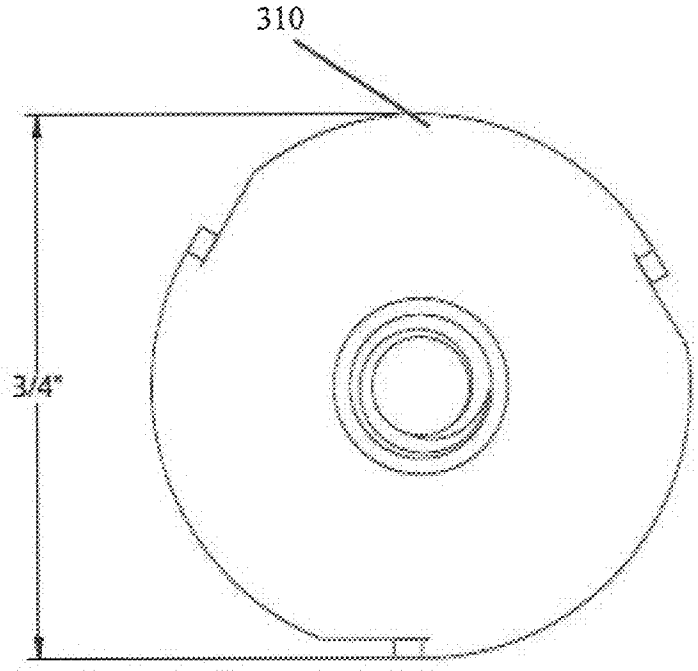

FIGS. 17A-17B show a more detailed view of the tee nuts connectors 310 used in the doormat. The tee nut connectors are adapted to be inserted into the countersunk openings in the recessed ends of the frame members 304*a-d* and to engage with the screws 309 which pass through the openings in the support brackets 308, the base 302 and the corner members 304*e*. In the present illustrative embodiment, the tee nut connectors 310 are made from stainless steel. However, in other embodiments, other metallic or non-metallic materials may be used provided they have sufficient strength.

Figure 18A:
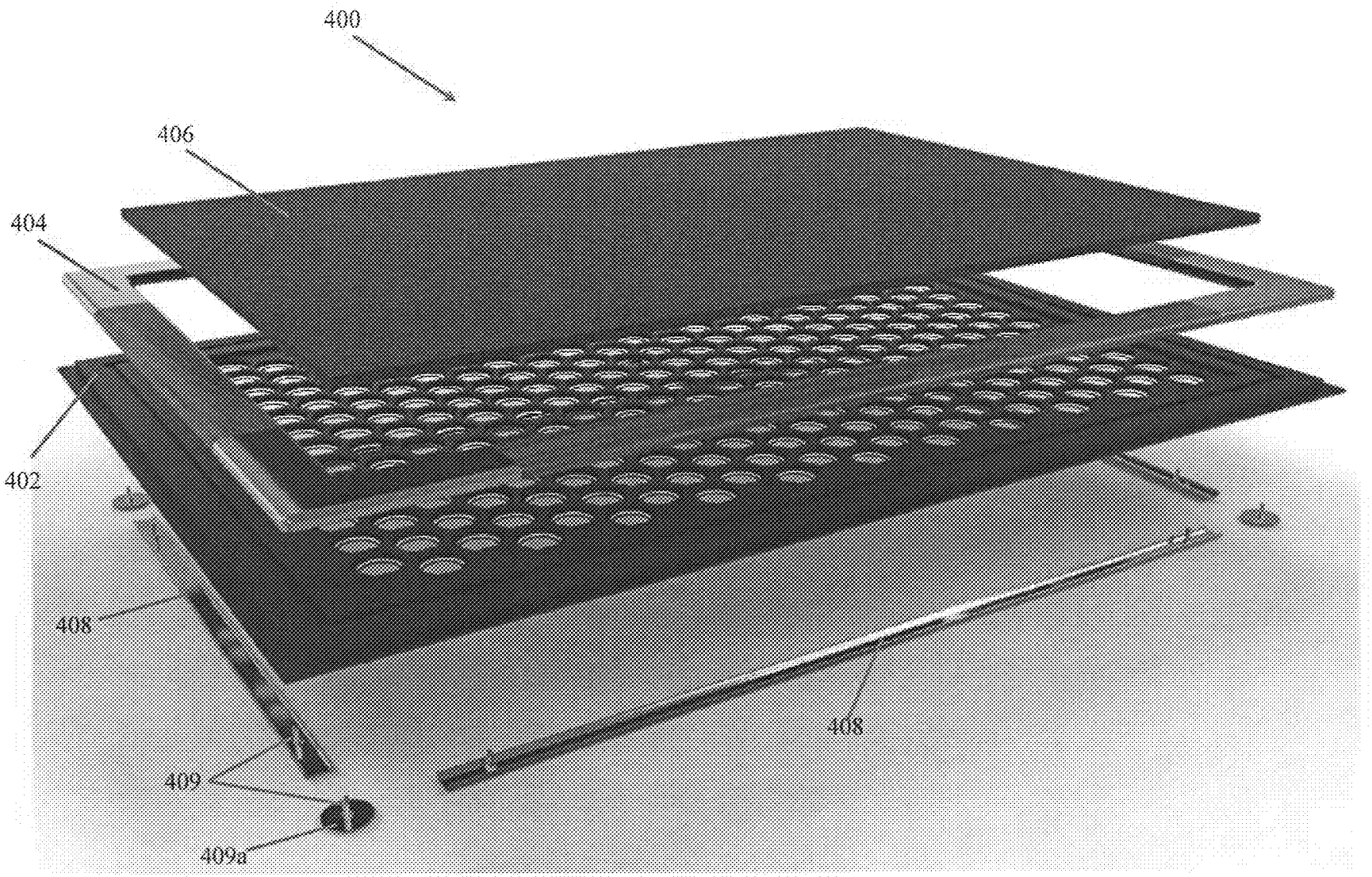
FIGS. 18A-18C show a fourth embodiment of the doormat.

FIGS. 18A-21C show a fourth embodiment of the doormat 400 which is a variation of the third embodiment. Since many of the features of the doormat 400 are the same or similar to those of the doormat 300 of FIGS. 9-17B, similar reference numbers are used for these features and detailed description thereof will be omitted. As shown in FIGS. 18A-18B, the doormat 400 of the fourth embodiment includes a base 402, a frame 404 provided on an upper surface of the base 402 and support brackets 408 provided on a lower surface of the base 402. The frame 404 and the support brackets 408 are engaged with the base 402 and with one another using connectors 309 or another suitable coupling mechanism so that an outer periphery of the base 402 is sandwiched between the frame 404 and the support brackets 408. The doormat 400 also includes a removable center insert 406 which can be removed for cleaning or exchanging with other removable center inserts. Materials used for these components of the doormat are the same or similar to those of the previously described embodiments. The configurations of the base 402 and the removable center insert 406 are substantially the same or similar to those of the third embodiment and thus, detailed descriptions thereof will be omitted.

As in the third embodiment, the frame 404 includes four side members 404*a-d* forming respective sides of the frame 404, and four corner members 404*e* forming the respective corners of the frame 404. The configuration of the four side members 404*a-d* is similar to those of the doormat 300 of the third embodiment. FIGS. 20A-20D show more detailed views of the side members 404*a-d*, wherein FIG. 20A shows the whole side member 404*a* and FIGS. 20B-20D show cross-sectional views of the side member 404*a* along lines A-A, B-B and C-C, respectively. The configuration of the other side members 404*b-d* is substantially the same as that of the side member 404*a*.

As shown in FIG. 20A, the side member 404*a* has a solid construction and includes a main body and recessed ends. A rib or protrusion 404*a*1 is provided on the lower surface of the side member 404*a* and extends along its entire length. The cross-section of the main body of the side member 404*a* is shown in FIG. 20C, and the cross-sections of the recessed ends of the side member 404*a* are shown in FIGS. 20B and 20D. In the illustrative embodiment of FIGS. 20B-20D, the main body and the recessed ends have a substantially rectangular cross-section with one side edge being rounded and another side edge being beveled. This profile of the side members allows for easy manufacture. However, in other embodiments, the cross-sections of the side members may be different and preferably match or are similar to the cross-sections of the corner members in order to provide a unitary and continuous appearance when assembled. In this illustrative embodiment, the recessed ends each include an opening that allows a screw boss of the corner member 404*e* and the connector 409 to pass through, and in this embodiment, the opening is not required to be countersunk due to the construction of the corner members 404*e*.

Figure 19A:
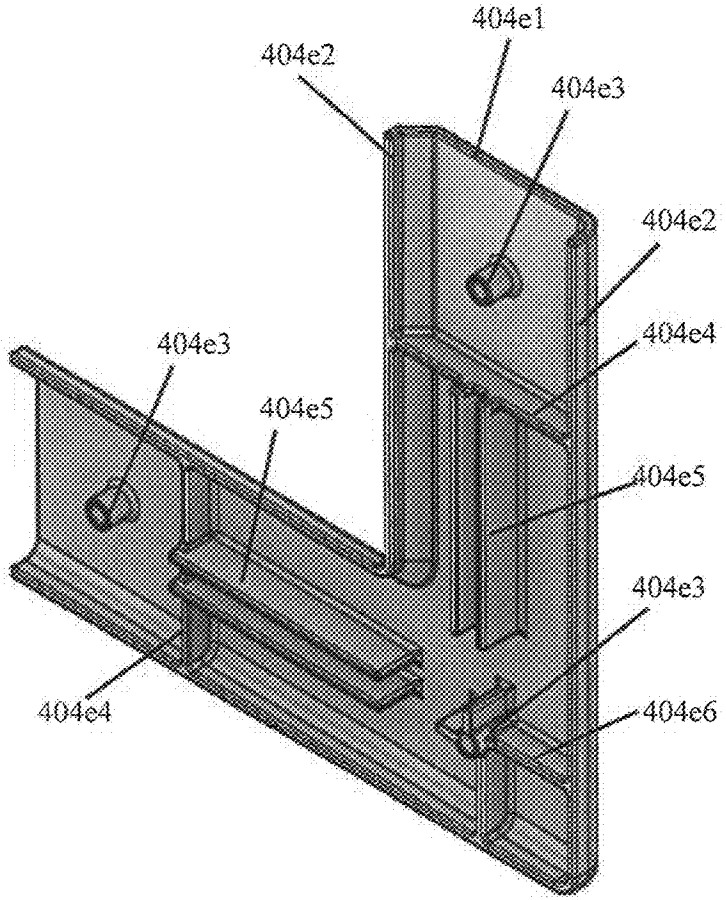
FIGS. 19A-19C show in more detail corner member of the frame of the doormat of FIGS. 18A-18C.
Figure 19B:
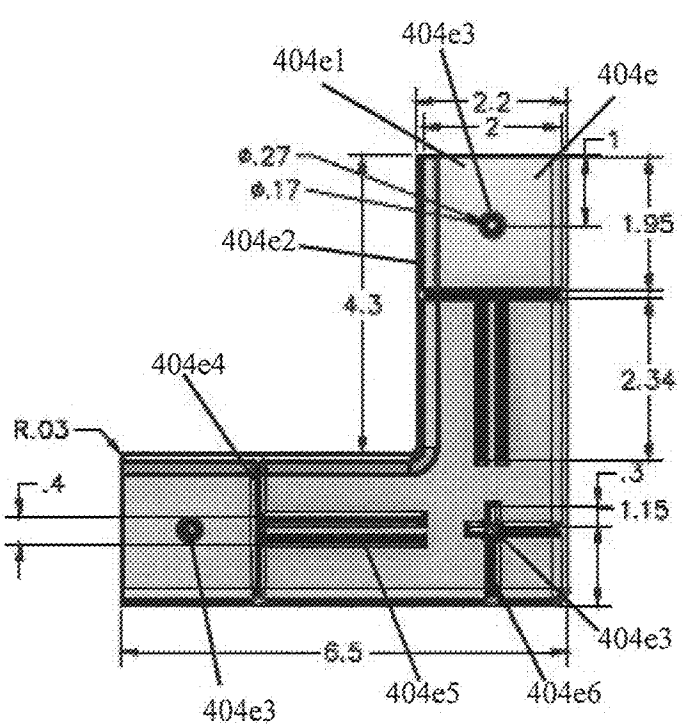
Figure 19C:
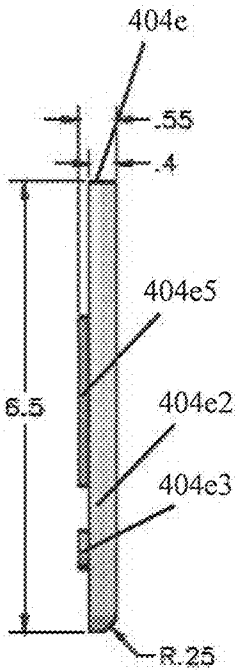

More detailed views of the corner members 404*e* are shown in FIGS. 19A-19C. As shown in FIGS. 19A-19C, the corner members 404*e* have different configuration from the corner members 304*e* of the third embodiment. In this illustrative embodiments, each of the corner members 404*e* has an L-shape and is open at its lower side. Specifically, each corner member 404*e* has an upper wall 404*e*1 defining the upper and outer surface of a frame corner and side walls 404*e*2 extending from the upper wall which, when assembled with corresponding side members, extend around the side walls of the recessed ends of the corresponding side members.

Each corner member 404*e* also includes one or more screw bosses 404*e*3 formed on the internal surface of the upper wall 404*e*1. The screw bosses 404*e*3 can pass through the corresponding openings in the recessed ends of the side members 404*a-d*, and are adapted to engage with connectors, such as screws 409, which pass through corresponding openings in support brackets 408 and/or the corresponding openings in the base 402. The screw bosses 404*e*3 incorporated into the corner members 404*e* eliminate the need for the tee nut connectors 310 of the third embodiment, and allow threat tapping of the screw connectors 409 to screw directly into the corner members 404*e*.

Figure 18B:
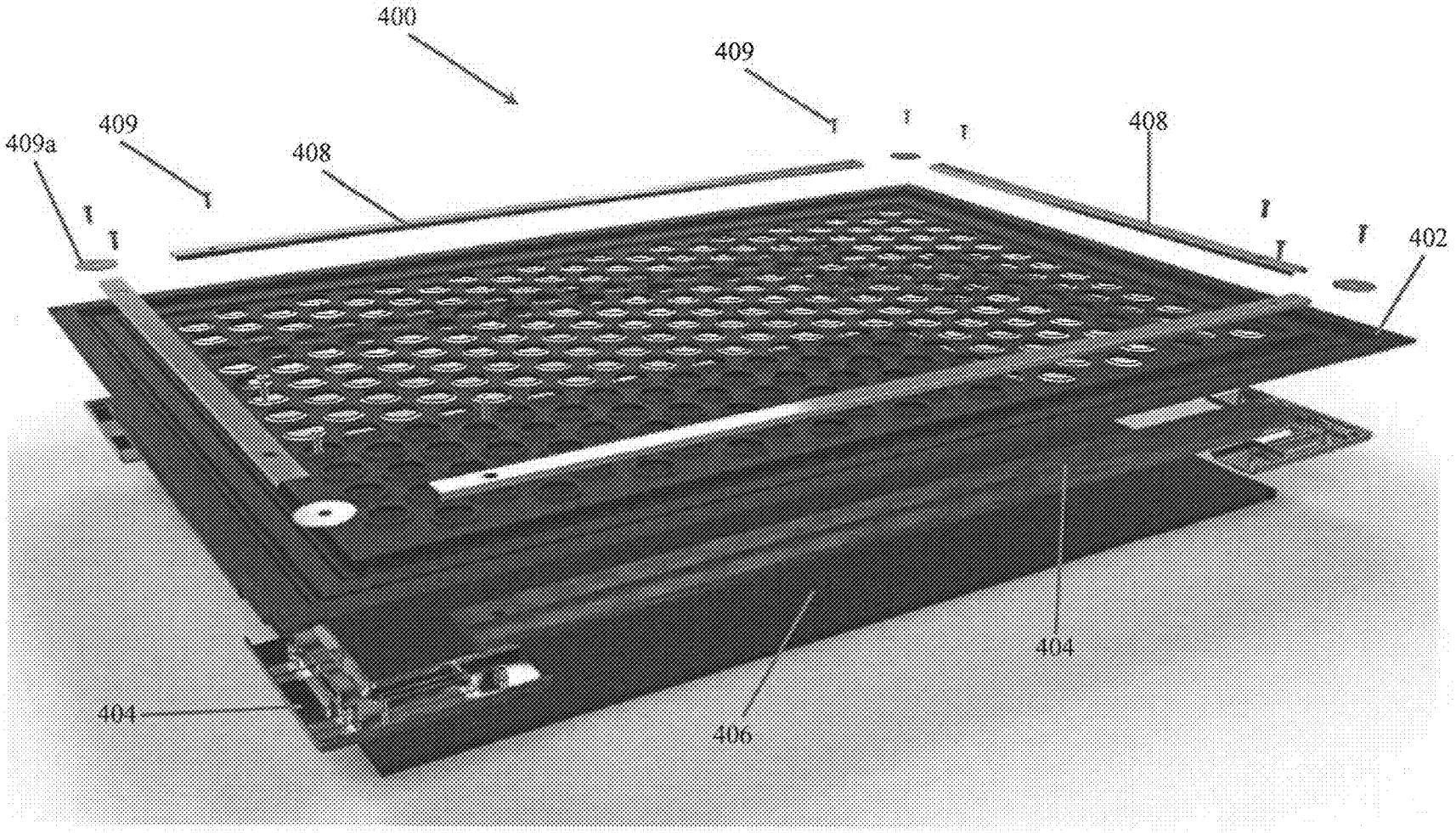
Figure 18C:
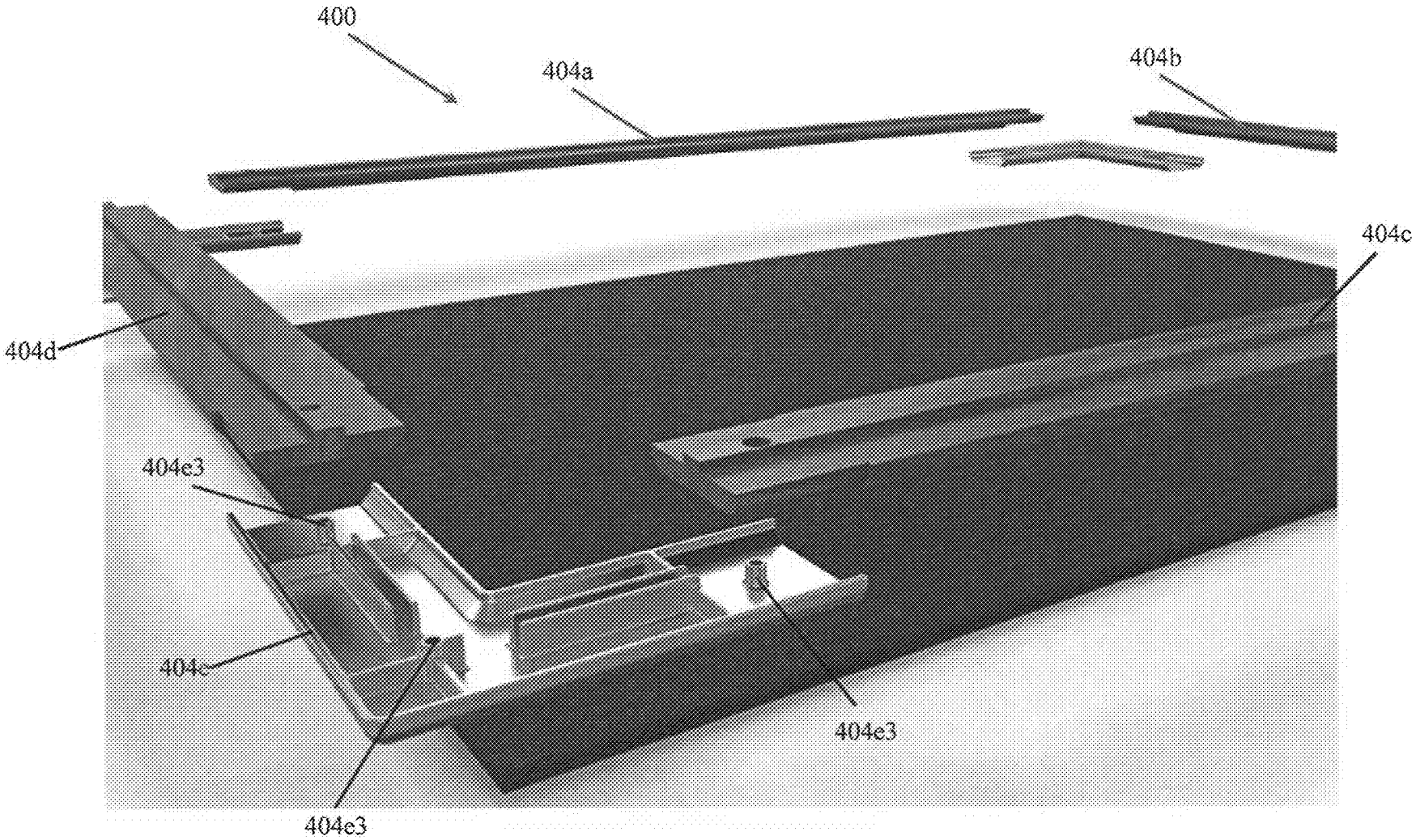

In the illustrative embodiment of FIGS. 19A-19B, each corner member 404*e* includes three screw bosses 404*e*3 provided at or near the end of each leg portion of the corner member 404*e* and provided at or near the corner of the corner member 404*e*. The screw bosses 404*e*3 provided on each leg portion of the corner member 404*e* are inserted into corresponding openings in the recessed ends of the side members 404*a-d* and when assembled, engage with screw connectors 409 that pass through corresponding openings in the support brackets 408, the base 402 and the side members 404*a-d*. Assembly of the side members 404*a-d* with the corner members 404*e* is shown in FIG. 18C, which shows alignment of the recessed ends of the side members 404*a-d* with the corner members 404*e* and placement so that the screw bosses 404*e*3 in the legs of the corner members 404*e* align with the corresponding openings in the recessed ends of the side members. The screw boss 404*e*3 provided at or near the corner of the corner member 404*e* engages with a screw connector 409 that passes through a corresponding opening in a corresponding corner of the base 402. As shown in FIGS. 18A-18B, washers 409*a* may be used with the screw connectors 409 that engage with the corner screw bosses 404*e*3. The washers may be formed from zinc plated steel or from any other suitable material. In other embodiments, a greater number or a smaller number of screw bosses 404*e*3 and of the corresponding openings may be used.

As shown in FIGS. 19A-19C, the corner members 404*e* also include framing projections 404*e*4-404*e*6 formed on the inner surface of the upper wall 404*e*1. These framing projections assist in aligning the side members 404*a*-404*e* with the corner members 404*e* (particularly, framing projections 404*e*4) and aligning the corner members 404*e* with the base 402 (particularly framing projections 404*e*5 which are configured to align with the channel between the inner and outer frame projections on the base). In addition, the framing projections 404*e*4-6 provide additional structural support to the corner member 404*e*.

FIGS. 21A-C show more detailed views of the support brackets 408 of the fourth embodiment. In this embodiment, the support brackets 408 have a C-shaped cross section, as can be seen in FIG. 21B taken along line J-J in FIG. 21A and in FIG. 21C taken along line K-K in FIG. 21A. The sidewalls of the C-shaped support brackets 408 can be fitted into corresponding channels formed on the lower surface of the base 402 so as to provide better engagement with the base and to add structural support to the base 402. As shown in FIGS. 21A and 21B, the support brackets 408 include an opening provided near each end to allow the screw connector 409 to pass through. The opening may be countersunk as in the third embodiment or may be formed without countersinking.

The constructions of the above-described doormats are sufficiently durable for outdoor use and have drainage ability so that water is not retained in the doormat. However, the doormats described above may also be adapted for indoor use. Moreover, the doormats of the present invention allow easy cleaning or replacement of the center inserts so as to allow the user to customize the appearance of the doormat without requiring complete replacement of the doormat.

In all cases it is understood that the above-described arrangements are merely illustrative of the many possible specific embodiments which represent applications of the present invention. Numerous and varied other arrangements can be readily devised in accordance with the principles of the present invention without departing from the spirit and the scope of the invention.

What is claimed is:

1. Doormat assembly comprising:

a base including a central area and a peripheral area surrounding the central area, and having an upper surface and an opposing lower surface;

a frame assembly overlapping with at least a portion of the upper surface of the peripheral area of the base and forming a frame with a central opening for exposing the central area of the base; and a removable insert unsecured to the base and sized to fit within the central opening of the frame assembly without overlapping with the frame assembly and to cover the central area of the base, wherein the frame assembly is formed separately from the base and the frame assembly comprises different materials from the base, wherein the frame assembly comprises a plurality of side members and a plurality of corner portions engaged with the side members to form the frame, and wherein the removable insert is removable through the central opening in the frame and replaceable.

2. Doormat assembly in accordance with claim 1, wherein the base comprises rubber material and the central area of the base includes a plurality of through openings for draining fluids.

3. Doormat assembly in accordance with claim 2, wherein the through openings are provided at substantially regular intervals throughout the central area of the base.

4. Doormat assembly in accordance with claim 3, wherein the through openings are hexagonally-shaped openings arranged in a honeycomb pattern throughout the central area of the base.

5. Doormat assembly in accordance with claim 2, wherein the base comprises at least one of nitrile-butadiene rubber (NBR) and styrene-butadiene rubber (SBR).

6. Doormat assembly in accordance with claim 3, wherein the thickness of the central area of the base is substantially the same and each of the through openings includes a beveled edge.

7. Doormat assembly in accordance with claim 1, wherein the peripheral area of the base is configured to engage with the frame assembly.

8. Doormat assembly in accordance with claim 1, wherein each end of one of the side members and the corner portions includes an opening and each end of the other one of the side members and the corner portions includes a recessed portion adapted to fit within the opening in the end of said one of the side members and the corner portions.

9. Doormat assembly in accordance with claim 1, wherein:

the peripheral area of the base includes a channel extending along its length, and each of the plurality of side members and each of the plurality of corner portions includes a protrusion extending along its length, said protrusion being configured to fit into the channel in the peripheral area.

10. Doormat assembly in accordance with claim 9, wherein the peripheral area of the base includes an inner frame-shaped protrusion extending around the central area of the base and an outer frame-shaped protrusion extending around the inner frame-shaped protrusion, and the channel in the peripheral area is formed between the inner frame-shaped protrusion and the outer frame-shaped protrusion.

11. Doormat assembly in accordance with claim 1, wherein the side members are formed from one or more of wood and bamboo, and wherein the corner portions are formed from a metallic material.

12. Doormat assembly in accordance with claim 1, wherein the size of the removable insert corresponds to the opening in the frame.

13. Doormat assembly in accordance with claim 1, wherein the removable insert comprises one or more of coir, horsehair bristles and polypropylene.

14. Doormat assembly in accordance with claim 1, wherein the upper surface of the base is shaped to interlock with an abutting surface of the frame assembly to restrict lateral shifting of the frame assembly relative to the base.

15. Doormat assembly in accordance with claim 1, wherein each of the plurality of side members does not overlap with any other of the plurality of side members.

16. Doormat assembly comprising:

a base including a central area and a peripheral area surrounding the central area, and having an upper surface and an opposing lower surface;

a frame assembly overlapping with at least a portion of the upper surface of the peripheral area of the base and forming a frame with a central opening for exposing the central area of the base;

a removable insert unsecured to the base and sized to fit within the central opening of the frame assembly without overlapping with the frame assembly and to cover the central area of the base; and support brackets abutting the lower surface of the peripheral area of the base, wherein said support brackets engage with the peripheral area of the base and the frame assembly, wherein the frame assembly is formed separately from the base and the frame assembly comprises different materials from the base, and wherein the removable insert is removable through the central opening in the frame and replaceable.

17. Doormat assembly in accordance with claim 16, wherein the lower surface of the peripheral area of the base includes a channel configured to accommodate the support brackets, and wherein the support brackets engage with the peripheral area of the base and the frame assembly using connectors.

18. Doormat assembly adapted for use with a removable and replaceable insert comprising:

a base including a central area and a peripheral area surrounding the central area, and having an upper surface and an opposing lower surface;

a frame assembly overlapping with at least a portion of the upper surface of the peripheral area of the base and forming a frame with a central opening for exposing the central area of the base;

wherein the frame assembly is formed separately from the base, wherein a removable and replaceable insert can be placed to cover the central opening through the central opening in the frame, and wherein the upper surface of the base is shaped to interlock with an abutting surface of the frame assembly to restrict lateral shifting of the frame assembly relative to the base.

19. Doormat assembly in accordance with claim 18, further comprising the removable insert sized to fit within the central opening of the frame assembly and to cover the central area of the base.

20. Doormat assembly in accordance with claim 18, the base includes a plurality of through openings for draining fluids provided only in the central area.

21. Doormat assembly in accordance with claim 18, wherein the frame assembly comprises a plurality of side members and a plurality of corner portions engaged with the side members to form the frame, and wherein each of the plurality of side members does not overlap with any other of the plurality of side members.

22. Doormat assembly in accordance with claim 18, wherein the frame assembly comprises different materials from the base.

23. Doormat assembly adapted for use with a removable and replaceable insert comprising:

a base including a central area and a peripheral area surrounding the central area, and having an upper surface and an opposing lower surface;

a frame assembly overlapping with at least a portion of the upper surface of the peripheral area of the base and forming a frame with a central opening for exposing the central area of the base;

wherein the frame assembly is formed separately from the base and comprises a plurality of side members and a plurality of corner portions engaged with the side members to form the frame, wherein each of the plurality of side members does not overlap with any other of the plurality of side members, and wherein a removable and replaceable insert can be placed to cover the central opening through the central opening in the frame.

* * * * *